US007197271B2

(12) United States Patent
Nakamura et al.

(10) Patent No.: US 7,197,271 B2
(45) Date of Patent: Mar. 27, 2007

(54) PRINTER AND IMAGE FORMING METHOD PROVIDING SELECTABLE PATH FOR RECORDING MEDIUM

(75) Inventors: Hiroaki Nakamura, Kanagawa (JP); Eiichi Kito, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 197 days.

(21) Appl. No.: 10/951,942

(22) Filed: Sep. 29, 2004

(65) Prior Publication Data

US 2005/0069354 A1 Mar. 31, 2005

(30) Foreign Application Priority Data

Sep. 30, 2003 (JP) ..... 2003-341345
Dec. 26, 2003 (JP) ..... 2003-433004

(51) Int. Cl.
*G03G 15/20* (2006.01)

(52) U.S. Cl. ..... 399/341

(58) Field of Classification Search ..... 399/341, 399/320

See application file for complete search history.

(56) References Cited

U.S. PATENT DOCUMENTS

2002/0191992 A1* 12/2002 Funato ..... 399/320

FOREIGN PATENT DOCUMENTS

JP 2000-221834 A 8/2000
JP 2002-123108 A 4/2002
JP 2003-5545 A 1/2003

* cited by examiner

*Primary Examiner*—Susan Lee
(74) *Attorney, Agent, or Firm*—Sughrue Mion, PLLC

(57) ABSTRACT

A printer includes: an image forming section that transfers a toner image onto a sheet-like recording medium conveyed on a conveyance-path, in which an electrostatic latent image is formed on a surface of an image carrier, and the toner image is formed on the surface of the image carrier by causing the electrostatic latent image to absorb toner; a primary fixing section disposed downstream of the image forming section in the conveyance-path and fixing on the recording medium the toner image transferred to the recording medium by the image forming section; a storage section disposed downstream of the primary fixing section in the conveyance-path and storing the recording medium on which the toner image is fixed by the primary fixing section; and a secondary fixing section disposed downstream of the storage section in the conveyance-path and performing a surface processing for the toner image fixed by the primary fixing section.

13 Claims, 22 Drawing Sheets

| SURFACE PROCESSOR ID | ID__01 | ID__02 | ID__03 | ID__04 | ID__05 |
|---|---|---|---|---|---|
| FINISH TYPE | GLOSSY | RASTER | MAT | SILK | SPECIAL PATTERN |
| FIXING MAX.SIZE | 297×420 | 210×297 | 210×297 | 210×297 | 107×154 |

Fig. 9

| SURFACE PROCESSOR ID | ID__01 | ID__02 | ID__03 | ID__04 | ID__05 |
|---|---|---|---|---|---|
| USABLE SHEET TYPE | CUT SHEET<br>1st ROLL<br>2nd ROLL | 1st ROLL | 1st ROLL<br>2nd ROLL | 1st ROLL<br>2nd ROLL | 1st ROLL |

Fig. 10

PRINTER AND IMAGE FORMING METHOD PROVIDING SELECTABLE PATH FOR RECORDING MEDIUM

BACKGROUND OF THE INVENTION

1. Field of the Invention

The present invention relates to a printer for forming an image on a recording medium in such a manner that an electrostatic latent image is formed on a surface of an image carrier, a toner image is formed on the surface of the image carrier by means of causing the electrostatic latent image to absorb toner, and transfer and fixing of the toner image are applied to the recording medium, and an image forming method of forming the image.

2. Description of the Related Art

Hitherto, a development of a film photographed by a camera and a print of photography are implemented in a so-called photofinishing laboratory, which is facility different-from a general store such as a photo studio. However, recently, there become popular photo studios having a small type of apparatus (hereinafter it is referred to as a mini-laboratory) for carrying out processing from printing to development necessary for printing of photography, so that a development of a film and a print of photography are performed in the photo studio. As the mini-laboratory to be installed in the photo studio, generally there is known an apparatus for obtaining a photographic image in such a manner that an image is exposed on a photographic paper in accordance with image data read from films and the like, and the photographic paper is passed through liquid such as developer and fixer. However, according to such a mini-laboratory, there is a need of replenishment of developer, fixer and water, and a periodical cleaning of a tank for saving those liquids, and in addition there is a need of processing for liquid waste, which will take trouble and cost for processing.

On the other hand, a so-called electrophotographic system of printer, which needs no processing for developer, fixer, water and liquid waste, is widely used in copying machines. According to the electrophotographic system of printer, an image is formed on a recording medium in such a manner that an electrostatic latent image is formed on a surface of an image carrier, the electrostatic latent image adsorbs a toner so that a toner image is formed on the surface of the image carrier, and transfer and fixing of the toner image to the recording medium are applied. However, an image, which is obtained through the electrophotographic system of printer, is worse than the conventional mini-laboratory in connection with an image quality such as a gloss on an image surface and thus it is not competent as a photographic image. Accordingly, it is considered that an electrophotographic system of printer is not competent to be applied to the mini-laboratory.

However, recently, a technology related to the image quality of the electrophotographic system of printer is advanced and thus it is considered that the electrophotographic system of printer is applied to the mini-laboratory. For example, there is proposed a printer (cf. Japanese Patent Laid Open Gazette TokuKai. 2003-5545 (pages 2–4, FIG. 1)) having a primary fixer for applying a primary fixing in which a toner image transferred to a recording medium is fixed on the recording medium, and a secondary fixer for applying a secondary fixing in which a surface of the fixed toner image is smoothed to provide a gloss, the secondary fixer being disposed downstream with respect to the primary fixer in the conveyance path for the recording medium.

While the printer disclosed in Japanese Patent Laid Open Gazette TokuKai. 2003-5545 is an apparatus that is supposed in application to copying machines and the like, the image quality of the image obtained through the printer is not worse than that of the photographic image obtained through the conventional mini-laboratory, and thus it is considered that that printer has a performance capable of being applied to the mini-laboratory.

According to the printer disclosed in Japanese Patent Laid Open Gazette TokuKai. 2003-5545, the secondary fixer for obtaining an image not worse than the photographic image applies the secondary fixing as set forth below.

First, the toner image, which is fixed on the recording medium by the primary fixer, is heated to fuse the toner, and a surface of the toner image fused in toner is urged to a smooth glossy surface. And the toner image is cooled in the urged state to solidify the fused toner. Thereafter, the toner image is separated from the glossy surface. This processing makes it possible to obtain an image of high picture quality having a gloss not worse than the photographic image.

The above-mentioned secondary fixing needs an extremely long processing time as compared with the primary fixing, since it takes a lot of time for a cooling of the toner image. For this reason, for example, in the event that a toner image is fixed on a plurality of recording media sequentially conveyed on a conveyance path in the apparatus, it would happen that before the secondary fixing for the preceding recording medium is terminated, the primary fixing for the subsequent recording medium is terminated. At that time, regardless of execution of the secondary fixing still, if the recording medium subjected to the primary fixing is conveyed to the secondary fixer, two recording media would collide with one another in the secondary fixer. In order to avoid such a trouble, according to the printer disclosed in Japanese Patent Laid Open Gazette TokuKai. 2003-5545, there is adopted such a sequence that the primary fixing is executed at a time interval of an extent that two recording media do not collide with one another in the secondary fixer, and in timing after the secondary fixing for the preceding recording medium is terminated and the preceding recording medium is conveyed from the secondary fixer to the further downstream side, the subsequent recording medium is conveyed to the secondary fixer.

As a typical example of this type of sequence, there is raised such a sequence that after the secondary fixing for the preceding recording medium is terminated and the recording medium is conveyed from the secondary fixer to a further downstream side, the primary fixing for the subsequent recording medium is initiated.

FIG. 4 is a view showing a typical example of a sequence consisting of the primary fixing and the secondary fixing for a plurality of recording media that are sequentially conveyed on a conveyance path, which is prevented from a collision on the conveyance path of two recording media continuously conveyed.

According to the sequence shown in FIG. 4, for example, the primary fixing for the recording medium for the second sheet is initiated after the secondary fixing for the recording medium for the first sheet is terminated. Also with respect to the recording medium for the third sheet et seqq., the fixing processing is applied in accordance with the same sequence. According to such a sequence, it is possible to prevent a collision on the conveyance path for two recording mediums to be continuously conveyed. However, according to the sequence shown in FIG. 4, the primary fixer would idle, after the primary fixing for the recording medium as an object in processing is terminated, in a state that no recording medium as an object in processing exists, until the secondary fixing for the preceding recording medium is terminated and the recording medium is conveyed from the secondary fixer to a further downstream side. Also with respect to the secondary fixer, the secondary would idle, after the secondary fixing for the recording medium as an object in processing is terminated, in a state that no recording medium as an object in processing exists, until the primary fixing for the subsequent recording medium is terminated and the recording medium is conveyed from the primary fixed to the secondary fixer. According to the sequence shown in FIG. 4, the idling operation of the primary fixer and the secondary fixer is repeated, and thus the working efficiency of the printer will be lowered.

In order to enhance the efficiency of the fixing processing of the primary fixing and the secondary fixing, there is considered, for example, a sequence that after the primary fixing for the recording medium as an object in processing is terminated, even if the secondary fixing for the preceding recording medium is not yet terminated, the primary fixing for the subsequent recording medium is initiated in timing that there is established a time interval in such an extent that no collision with the preceding recording medium occurs on the conveyance path. However, even such a sequence is concerned, there exists a period of time of the idling operation of the primary fixer and the secondary fixer, although it is reduced as compared with the sequence shown in FIG. 4, and thus the working efficiency of the printer will be lowered by the corresponding.

SUMMARY OF THE INVENTION

In view of the foregoing, it is an object of the present invention to provide a printer and an image forming method capable of being applied to a mini-laboratory, which is concerned with an electrophotographic system and is high in working efficiency.

To achieve the above-mentioned object, the present invention-provides a first printer comprising:

an image forming section that transfers a toner image onto a sheet-like shaped recording medium conveyed on a predetermined conveyance path, in which an electrostatic latent image is formed on a surface of an image carrier, and the toner image is formed on the surface of the image carrier by means of causing the electrostatic latent image to absorb toner;

a primary fixing section disposed at a downstream side of the image forming section in the conveyance path, the primary fixing section fixing on the recording medium the toner image transferred to the recording medium by the image forming section;

a storage section disposed at a downstream side of the primary fixing section in the conveyance path, the storage section storing the recording medium on which the toner image is fixed by the primary fixing section; and a secondary fixing section disposed at a downstream side of the storage section in the conveyance path, the secondary fixing section performing a surface processing for the toner image fixed by the primary fixing section.

According to the first printer of the present invention, temporarily storing the recording mediums passing through the primary fixing section in the storage section makes it possible to prevent a collision of the recording mediums passing through the primary fixing section with the recording mediums in processing in the primary fixing section on the conveyance path. According to the first printer of the present invention, a provision of the storage section makes it possible that the primary fixing section performs the fixing processing of toner for the recording medium conveyed on the conveyance path, regardless of progress of the surface processing in the secondary fixing section, and the secondary fixing section performs the surface processing of the toner image for the recording mediums derived and conveyed from the storage section, regardless of progress of the fixing processing in the primary fixing section. In other words, according to the first printer of the present invention, it is possible to efficiently form a high picture quality of image without uselessness in operation of the primary fixing section and the secondary fixing section.

In the first printer according to the present invention as mentioned above, it is preferable that the printer further comprises a guide section disposed between the primary fixing section and the storage section in the conveyance path, the guide section selectively distributing the recording medium on which the toner image is fixed by the primary fixing section to a first conveyance path toward the storage section and a second conveyance path for making a detour to avoid the storage section and the secondary fixing section.

In customers who give orders to a photo studio and the like, there are customers who consider a normal picture quality obtained through only fixing of a toner image by the primary fixing section to be sufficient, as well as customers who require a photographic image level of high picture quality.

According to the first printer of the present invention, even in the event that the processing for normal picture quality and the processing for high picture quality are mixed, it is possible to efficiently form images.

To achieve the above-mentioned object, the present invention provides a second printer comprising:

a medium supplying section that supplies to a predetermined conveyance path a recording medium selected from among a plurality of sorts of sheet-like shaped recording mediums;

an image forming section that transfers a toner image onto the recording medium supplied from the medium supplying section and conveyed on the predetermined conveyance path, in which an electrostatic latent image is formed on a surface of an image carrier, and the toner image is formed on the surface of the image carrier by means of causing the electrostatic latent image to absorb toner;

a primary fixing section disposed at a downstream side of the image forming section-in the conveyance path, the primary fixing section fixing on the recording medium the toner image transferred to the recording medium by the image forming section;

a secondary fixing section disposed at a downstream side of the primary fixing section in the conveyance path, the secondary fixing section performing a surface processing for the toner image fixed by the primary fixing section, and having at least one sort of surface processor selected from a plurality of sorts of surface processors, wherein the selected surface processor is exchangeable with the plurality of sorts of surface processors;

a memory section that stores an association between sorts of the surface processors and sorts of the recording mediums;

a decision section that obtains a sort of recording medium supplied from the medium supplying section and a sort of the surface-processor involved in the secondary fixing section, and decides whether those sorts are associated with one another in the association stored in the memory section; and a guide section disposed between the primary fixing section and the secondary fixing section in the conveyance path, the guide section guiding the recording medium on which the toner image is fixed by the primary fixing section to a first conveyance path passing through the secondary fixing section, when the decision section decides that the sort of recording medium and the sort of the surface processor are associated with one another in the association stored in the memory section, and the guide section guiding the recording medium on which the toner image is fixed by the primary fixing section to a second conveyance path for making a detour to avoid the secondary fixing section, when the decision section decides that the sort of recording medium and the sort of the surface processor are not associated with one another in the association stored in the memory section According to the second printer of the present invention, the recording medium is guided to the secondary fixing section, when the decision section decides that the sort of recording medium supplied from the medium supplying section is associated with the sort of the surface processor of the secondary fixing section. Thus, it is possible to obtain a good surface processing. On the other hand, when the decision section decides that the sort of recording medium supplied from the medium supplying section is not associated with the sort of the surface processor of the of the secondary fixing section, the recording medium is guided to make a detour to avoid the secondary fixing section. Thus, it is possible to prevent such an in convenience that the surface processing is inadvertently applied to the inadequate recording medium, and thereby avoiding waste of sheets and processing times.

In the second printer according to the present invention as mentioned above, it is preferable that the secondary fixing section has a plurality of sorts of surface processors;

the first conveyance path branches to a plurality of branch paths directed to the plurality of sorts of recording mediums;

the decision section decides the surface processor of the sort associated with the sort of the recording medium supplied from the medium supplying section in the association, of the plurality of surface processors involved in the secondary fixing section; and the guide section guides the recording medium to the branch path directed to the surface processor decided in the decision section.

According to the second printer as mentioned above, even if an operator does not know an association between a sort of the recording medium and a sort of the surface processor, provision of a plurality of surface processors makes it possible to automatically perform the surface processing suitable for the recording medium.

In the second printer according to the present invention as mentioned above, it is preferable that the printer further comprises an image display section that displays a surface condition of the toner image transferred by the image forming section and subjected to a surface processing by the surface processor before the medium supplying section supplies the recording medium.

According to the second printer as mentioned above, it is possible for an operator to confirm the surface state of the toner image subjected to the surface processing before actual surface processing is applied.

To achieve the above-mentioned object, the present invention provides a third printer that forms a color image consisting of a fixed toner image on a conveyed recording sheet in such a manner that toner images by a plurality of colors of color toners are transferred and fixed on the recording sheet, the printer comprising:

an image forming section that forms toner images by a plurality of colors of color toners and transfers the same onto a recording sheet;

a primary fixing section that fixes a toner image transferred onto a recording sheet on the recording sheet;

a secondary fixing section that fuses at least a surface portion of the toner image fixed by the primary fixing section to-regulate the surface of the toner image; and a distribution section that distributes recording sheets at an upper stream side with respect to a sheet conveyance direction of the secondary fixing section in a width direction intersecting the sheet conveyance direction.

The feature of the third printer of the present invention makes it possible to simultaneously carry out processing for regulating the surfaces of a plurality of recording sheets in the secondary fixing section. Accordingly, it is possible to reduce the processing time for regulating a surface of the toner images to be carried out in the secondary fixing section and thereby efficiently forming an image of high picture quality.

In the third printer according to the present invention as mentioned above, it is preferable that the distribution section is disposed between the first fixing section and the secondary fixing section, and distributes recording sheets carrying toner images after fixed in the first fixing section in the width direction.

This feature makes it possible to reduce a size of the conveyance path in the width direction.

In the third printer according to the present invention as mentioned above, it is preferable that instead of an arrangement in which the distribution section is disposed separately from the primary fixing section, the primary fixing section distributes recording sheets in the width direction while fixing toner images transferred to recording sheets on the recording sheets.

This feature makes it possible to contribute to miniaturization of the apparatus.

In the third printer according to the present invention as mentioned above, it is preferable that the printer further comprises a collecting section that collects the recording sheets distributed in the width direction and passing through the secondary fixing section, at a downstream side with respect to the sheet conveyance direction of the secondary fixing section.

This feature makes it possible to suppress a size of the sheet conveyance path at the downstream side of the collecting section in the width direction small and also to reduce troubles of collecting the recording sheets.

To achieve the above-mentioned object, the present invention provides an image forming method of forming a color image consisting of a fixed toner image on a conveyed recording sheet in such a manner that toner images by a plurality of colors of color toners are transferred and fixed on the recording sheet, the image forming method comprising:

an image forming step that forms toner images by a plurality of colors of color toners and transfers the same onto a recording sheet;

a primary fixing step that fixes a toner image transferred onto a recording sheet on the recording sheet;

a distribution step that distributes recording sheets on which toner images are fixed in the primary fixing step in a width direction intersecting the sheet conveyance direction;

a secondary fixing step that fuses at least a surface portion of the fixed toner image on the recording sheets distributed in the distribution step to regulate the surface of the toner image.

The feature of the image forming method of the present invention makes it possible to simultaneously carry out processing for regulating the surfaces of a plurality of recording sheets in the secondary fixing step. Accordingly, it is possible to reduce the processing time for regulating a surface of the toner images to be carried out in the secondary fixing section and thereby efficiently forming an image of high picture quality.

In the image forming method according to the present invention as mentioned above, it is preferable that the distribution step distributes recording sheets carrying toner images after fixed in the first fixing step in the width direction.

This feature makes it possible to reduce a size of the conveyance path in the width direction.

In the image forming method according to the present invention as mentioned, it is preferable that instead of an implementation in which the distribution step is executed independently of the primary fixing section, the primary fixing section distributes recording sheets in the width direction while fixing toner images transferred to recording sheets on the recording sheets.

This feature makes it possible to suitably apply the method to a small type of apparatus.

In the image forming method according to the present invention as mentioned above, it is preferable that the image forming method further comprises a collecting step that collects the recording sheets carrying the fixed toner image regulated in surface in the secondary fixing step.

This feature makes it possible to reduce troubles of collecting the recording sheets.

BRIEF DESCRIPTION OF THE DRAWINGS

FIG. 9 is an explanatory view useful for understanding sorts of detachable surface processors as the surface processor shown in FIG. 8.

FIG. 10 is an explanatory view useful for understanding an association between the surface processors and sheets capable of being subjected to surface processing by the surface processors.

DETAILED DESCRIPTION OF PREFERRED EMBODIMENTS

Embodiments of the present invention will be described with reference to the accompanying drawings.

Figure 1:
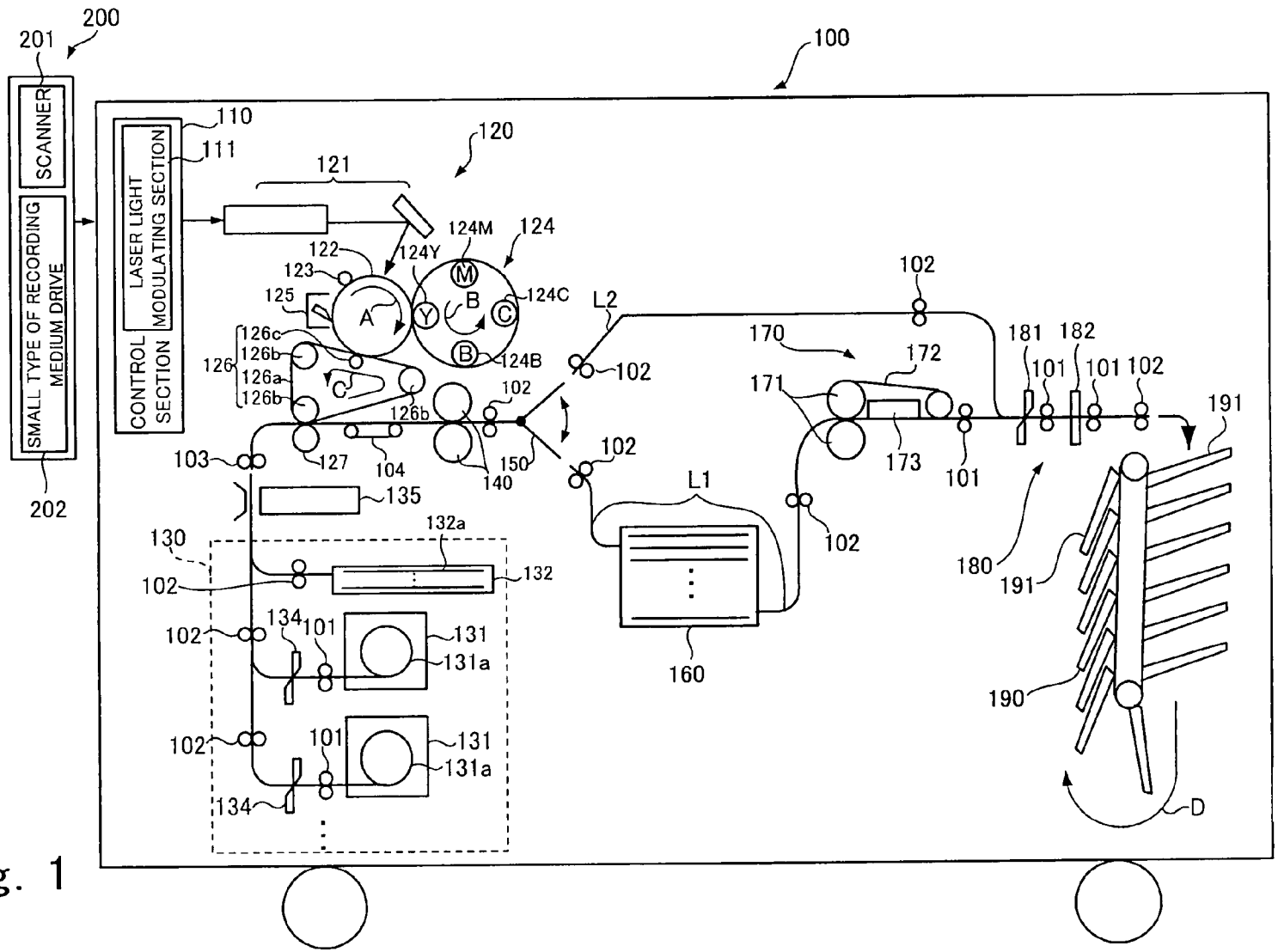
FIG. 1 is a view useful for understanding a first embodiment of a printer according to the present invention.

FIG. 1 is a view useful for understanding a first embodiment of a printer according to the present invention.

FIG. 1 shows a system of a mini-laboratory comprising a printer 100 and an image input unit 200.

The image input unit 200 comprises a scanner 201 for optically reading a photographic image recorded on a photographic film to generate photographic image data, and a small type of recording medium drive 202 for reading from a small type of recording medium the photographic image data that is recorded on the small type of recording medium through photography by digital camera and the like. The image input unit 200 generates output image data through application of correcting processing such as a color tone correction and a correction for white balance to the photographic image data obtained via the scanner 201 or the small type of recording medium drive 202. The output image data thus generated is transmitted to the printer 100.

The printer 100 shown in FIG. 1 forms an image, which consists of a fixed toner image on a recording medium, in such a manner that an electrostatic latent image is formed, a toner image is formed through a development of the electrostatic latent image with a toner, and the toner image is finally transferred and fixed onto the recording medium. Specifically, the printer 100 has developing devices for each of colors of yellow (y), magenta (M), cyan (C), and black (B). According to the printer 100, it is possible not only to print a monochromatic image, but also to print a full color of image consisting of toner images of four colors of yellow (y), magenta (M), cyan (C), and black (B).

The printer 100 has a control section 110 including a laser light modulation section 111 for modulating a laser beam emitted from the laser in accordance with output image data outputted from the image input unit 200. The control section 110 controls operations of the structure elements of the printer 100.

The printer 100 has an image forming section 120 for transferring a toner image onto a sheet-like shaped recording medium conveyed on a predetermined conveyance path. The image forming section 120 corresponds to an example of the image forming section in the first printer according to the present invention.

The image forming section 120 comprises an exposure section 121, an image carrier roll 122, a charging roll 123, a development unit 124, a cleaner 125, an intermediate transfer section 126, and a secondary transfer roll 127.

The image carrier roll 122, which rotates in an arrow A direction, is charged in its surface by the charging roll 123. The thus charged surface of the image carrier roll 122 is scanning-exposed by the exposure section 121 with laser beams modulated in accordance with the output image data outputted from the image input unit 200. Thus, there is formed an electrostatic latent image consisting of a predetermined surface potential on the surface of the image carrier roll 122.

The exposure section 121 comprises a light source (not illustrated) such as a semiconductor laser, and an optical system for performing a scanning-exposure by leading laser beams emitted from the light source onto the image carrier roll 122 in accordance with the output image data outputted from the image input unit 200, the optical system comprising a polygon mirror, a reflection mirror and various sorts of lenses. The exposure section 121 serves to write the electrostatic latent image onto the image carrier roll 122.

The developing unit 124 comprises developing devices 124Y, 124M, 124C and 124B for each of colors of yellow (y), magenta (M), cyan (C), and black (B), which are disposed at intervals of 90°. Any of the developing devices 124Y, 124M, 124C and 124B adopts a so-called magnetic brush development scheme, and accommodates therein two-component developer including a toner and a carrier. The developing unit 124 rotates in an arrow B direction at intervals of intervals of 90°, so that any one of the developing devices 124Y, 124M, 124C and 124B closely faces the image carrier roll 122 keeping a predetermined minute distance. The developing device, which closely faces the image carrier roll 122, causes a toner to adhere on an electrostatic basis to the electrostatic latent image formed on the surface of the image carrier roll 122 in accordance with the magnetic brush effect, so that a toner image of a color associated with the developing device is formed on the surface of the image carrier roll 122.

The intermediate transfer section 126 is constructed in such a manner that an intermediate transfer belt 126*a* is constructed movably in an arrow C direction by catenary rolls 126*b*. A primary transfer roll 126*c* is disposed at a primary transfer position in which the intermediate transfer belt 126*a* is closely contact with the image carrier roll 122. The primary transfer roll 126*c* applies a transfer voltage to the intermediate transfer belt 126*a*. The toner image, which is formed on the surface of the image carrier roll 122 by the developing devices 124Y, 124M, 124C and 124B incorporated into the developing unit 124, is transferred to the intermediate transfer belt 126*a* by the transfer voltage at the primary position.

In the event that an image now to be formed is a color image, first, the exposure section 121 forms an electrostatic latent image for yellow (Y) on the surface of the image carrier roll 122. A toner is absorbed into the electrostatic latent image from the developing device 124Y for yellow closely facing the image carrier roll 122 by rolling of the developing unit 124, so that a toner image of yellow is formed on the surface of the image carrier roll 122. The toner image of yellow is transferred to the intermediate transfer belt 126*a*. Thereafter, the exposure section 121 forms an electrostatic latent image for magenta (M) on the surface of the image carrier roll 122, which is removed in the residual toner on its surface by the cleaner 125. At that time, a toner is absorbed into the electrostatic latent image from the developing device 124M for magenta closely facing the image carrier roll 122 by rolling of the developing unit 124 by 90°, so that a toner image of magenta is formed on the surface of the image carrier roll 122. The toner image of magenta is transferred to the intermediate transfer belt 126*a* in such a manner that the toner image of magenta is superposed on the toner image of yellow, which is already transferred. Hereinafter, in a similar fashion, toner images of the remaining cyan (C) and black (B) are sequentially transferred onto the intermediate transfer belt 126*a*. A control section 110 controls the catenary rolls 126*b* for moving the intermediate transfer belt 126*a* so that the toner images for the respective colors, which are sequentially transferred, are exactly overlapped with one another.

In the event that an image now to be formed is a monochromatic image, in a similar fashion to that of the color image, only the toner of black (B) is transferred to the intermediate transfer belt 126*a*.

The toner image transferred via the above-mentioned operation to the intermediate transfer belt 126*a* is further transferred to a sheet-like shaped recording medium conveyed from a recording medium supplying section 130, which will be explained later, by the secondary transfer roll 127 disposed over against one of the catenary rolls 126*b* via the intermediate transfer belt 126*a*. As a result, a toner image of color or a monochromatic toner image is formed on the surface of the recording medium.

Next, there will be explained the recording medium supplying section 130 for supplying the sheet-like shaped recording medium to the image forming section 120, which the printer 100 shown in FIG. 1 is provided with.

The recording medium supplying section 130 is provided with a roll paper storage section 131 to be loaded with a rolled roll paper 131*a* as the recording medium. While FIG. 1 shows two roll paper storage sections 131 by way of example, the present invention is not restricted to this embodiment. It is acceptable that a printer of the present invention is provided with the roll paper storage section 131 by only one, or alternately it is acceptable that a printer of the present invention is provided with three or more roll paper storage sections 131 to be loaded with roll papers 131*a* which are different from one another in size in a width direction and a sort.

The roll paper 131*a* is drawn out by a positioning roll 101, which is provided in the vicinity of a roll paper taking out slot of the roll paper storage section 131, and is conveyed to a roll paper cuter 134, which is disposed at the downstream side of the positioning roll 101 in the conveyance path for the recording medium. After the roll paper 131*a* is subjected to the positioning by the positioning roll 101, the roll paper 131*a* is cut by a roll paper cutter 134 into a predetermined size. The positioning roll 101 is controlled by the control section 110 so that the positioning roll 101 makes a positioning of the roll paper 131*a* in accordance with a size of a paper to be cut.

The sheet-like shaped recording paper, which is cut out from the roll paper storage section 131, is conveyed by a plurality of conveyance rolls 102 disposed at several places on the conveyance path that is formed with the plurality of rolls 102 in the printer 100.

The recording medium supplying section 130 is also provided with a sheet cassette 132 for storing a sheet-like recording sheet 132*a* as the recording medium. While FIG. 1 shows, by way of the example, the sheet cassette 132 by only one, the present invention is not restricted to the present embodiment. According to a printer of the present invention, it is acceptable that there is provided for example a plurality of sheet cassettes 132 for storing recording sheets 132*a* that are different from one another in size and sort.

The recording sheets 132*a* are taken out by the conveyance roll 102, which is provided in the vicinity of a recording paper taking out slot of the sheet cassette 132, and is conveyed to the downstream side in the conveyance path for the recording medium.

The conveyance path from the roll paper cutter 134 and the conveyance path from the sheet cassette 132 are combined into a single conveyance path at the downstream side. On the single conveyance path, there is disposed a printing head 135 for printing various sorts of print information on a back of the conveyed recording paper. The print information printed by the printing head 135 includes, for example, information such as various sorts of set up parameters in image forming set up by an operator, as well as a frame number indicative of correspondence of an image to be printed on the recording paper to an image on a film, and date of the photography of the image.

A resist roll 103, which is disposed at the downstream side with respect to the printing head 135, conveys the recording paper subjected to printing onto the back by the printing head 135 to the secondary transfer roll 127 of the image forming section 120, which is located at the further downstream side of the conveyance path, in accordance with timing (which will be described later). The secondary transfer roll 127 transfers color or monochromatic toner image, which is already formed on the intermediate transfer belt 126*a*, onto the recording paper thus conveyed.

As mentioned above, in the event that the toner image of color is formed on the intermediate transfer belt 126*a*, the intermediate transfer belt 126*a* rotatably moves four times in an arrow C direction so that toner images of YMCB four colors are transferred onto the intermediate transfer belt 126*a* one by one in color whenever the intermediate transfer belt 126*a* rotates once. According to the present embodiment, in the event that the toner image of color is formed on the intermediate transfer belt 126*a*, a conveyance of the recording paper to the secondary transfer roll 127 by the resist roll 103 is carried out in such a manner that the recording paper is conveyed to the secondary transfer roll 127 in timing that the toner image of color formed on the intermediate transfer belt 126*a* through transfer of toner images of all four colors first faces the secondary transfer roll 127. The control section 110 controls the resist roll 103 so as to perform a conveyance of the recording medium in the timing as mentioned above.

In the manner as mentioned above, the recording paper, onto which the toner image is transferred, is conveyed via a conveyance belt 104 disposed at the downstream side of the secondary transfer roll 127 to a primary fixing section 140 that is disposed at the further downstream side of the conveyance path. The primary fixing section 140 applies heating and pressure processing to the recording paper, onto which the toner image is transferred, so that the toner image is fixed on the recording paper. The primary fixing section 140 corresponds to an example of the primary fixing section in a printer of the present invention. An image, which is obtained through fixing of the toner by the primary fixing section 140, has an image quality equivalent to that of an image obtained by a color copying machine and the like, while it falls short of high picture quality required for photographic image and the like.

The recording paper, which is subjected to the processing by the primary fixing section 140, is conveyed to a guide section 150 disposed at the downstream side of the primary fixing section 140 in the conveyance path.

The guide section 150 distributes the recording paper to a first conveyance path L1 toward a storage section 160 (which will be explained later) and a second conveyance path L2 for making a detour to avoid the storage section 160 and a secondary fixing section 170 (which will be explained later). The storage section 160 corresponds to an example of the storage section in a printer of the present invention. The guide section 150 corresponds to an example of the guide section in a printer of the present invention. The secondary fixing section 170 corresponds to an example of the secondary fixing section in a printer of the present invention.

As will be described later, the first conveyance path L1 is for applying to a recording paper a processing to obtain a photographic image level of high picture quality. The second conveyance path L2 is for leading the recording paper passing through the primary fixing section 140 to the output side of the printer 100 directly, omitting the processing as mentioned above with respect to the first conveyance path L1. Regarding a selection between the first conveyance path L1 and the second conveyance path L2, an operator sets up it in compliance with the wishes of customers.

In customers who give orders to a photo studio and the like, there are customers who consider a normal picture quality obtained through only fixing of a toner image by the primary fixing section 140 to be sufficient, as well as customers-who require a photographic image level of high picture quality. In the event that the processing for normal picture quality and the processing for high picture quality are mixed, the guide section 150 selectively guides a recording paper to any one of the first conveyance path L1 and the second conveyance path L2 in accordance with set up by the operator in compliance with the wishes of the customers.

The recording paper guided by the guide section 150 to the first conveyance path L1 is conveyed to the storage section 160 so as to be stored therein. According to the present embodiment, recording papers, which are sequentially conveyed to the storage section 160, are stacked up in the storage section 160. When the recording papers are derived from the storage section 160, the recording papers are derived one by one from the bottom recording paper in order.

The recording paper derived from the storage section 160 is conveyed to the secondary fixing section 170 that is disposed at the downstream of the storage section 160 in the first conveyance path L1.

The secondary fixing section 170 comprises a heating and pressure rolls 171 for applying the heating and pressure processing to the conveyed recording paper, a secondary fixing belt 172 having a smooth glossy surface, the secondary fixing belt 172 circularly moving, and a cooler 173 for cooling the recording paper heated by the heating and pressure rolls 171.

In the secondary fixing section 170, first, the heating and pressure rolls 171 heat and fuse the toner image fixed on the recording paper in the primary fixing section 140, and press the surface of the fused toner image against the smooth glossy surface of the secondary fixing belt 172. The recording paper is conveyed to the downstream side in the state that the recording paper is sticking to the glossy surface of the secondary fixing belt 172. The recording paper, which is sticking to the glossy surface, is cooled by the cooler 173 disposed at the downstream of the heating and pressure rolls 171. Thus, the toner image fused on the recording paper is solidified. Thereafter, the recording paper is conveyed to the further downstream side, and is separated from the glossy surface of the secondary fixing belt 172 by rigidity of the recording paper itself as the secondary fixing belt 172 is flexible.

The surface of the recording paper is formed with a transparent resin layer. After the recording paper is subjected to the processing by the primary fixing section 140, the surface of the recording paper offers a state that a toner image is fixed on the resin layer. In this condition, when the recording paper is subjected to the processing by the secondary fixing section 170, the resin layer and the toner image are fused together, so that both the resin layer and the toner image are united with one another and the surface of the recording paper is pressed on the glossy surface of the secondary fixing belt 172 and is solidified. This processing by the secondary fixing section 170 makes it possible to a high picture quality of image having a gloss, which is not worse than the photographic image.

The processing by the secondary fixing section 170 takes a lot of time particularly for the cooling processing for the recording paper by the cooler 173. Thus, as compared with the processing by the primary fixing section 140, the processing by the secondary fixing section 170 needs longer processing times. However, according to the present embodiment, the storage section 160 is disposed at the upper stream side of the secondary fixing section 170 and the recording paper, which is completed in fixing by the primary fixing section 140, is stored in order during the processing by the secondary fixing section 170. Accordingly, regardless of the progress of the processing in the secondary fixing section 170, the primary fixing section 140 performs the fixing processing of the toner for the conveyed recording paper. And regardless of the progress of the processing in the primary fixing section 140, the secondary fixing section 170 performs the processing for the recording paper derived and conveyed from the storage section 160. In other words, according to the printer 100 shown in FIG. 1, it is possible to efficiently form a high picture quality of image without uselessness in operation of the primary fixing section 140 and the secondary fixing section 170.

The first conveyance path L1 and the second conveyance path L2 for making a detour to avoid the storage section 160 and the secondary fixing section 170 are combined into a single path at the downstream side of the secondary fixing section 170. An XY cutter 180 is disposed at the further downstream side of the single path. The recording paper is conveyed via the secondary fixing section 170 or the second conveyance path L2 to the XY cutter 180.

The XY cutter 180 comprises a first cutter 181 for cutting the recording paper vertically with respect to the conveyance direction, and a second cutter 182 for cutting the recording paper along the conveyance direction. The first cutter 181 and the second cutter 182 are disposed in series on the conveyance path. Positioning rolls 101 are disposed between the first cutter 181 and the second cutter 182, and at the downstream side of the second cutter 182, respectively. Those positioning rolls 101 perform the positioning of the recording paper for the XY cutter 180. The control section 110 controls the positioning rolls 101 to perform the positioning of the recording paper.

The cutting of the recording paper by the XY cutter 180 is carried out by set up of an operator in compliance with the wishes of customers. For example, in the event that the recording paper conveyed to the XY cutter 180 is one cut out from a roll paper 131*a*, and a size of the recording paper cut out from the roll paper 131*a* is larger somewhat than the photographic size, the XY cutter 180 carries out the cutting in accordance with the is photographic size. In the event that what a customer wishes is a photographic print having no frame, the XY cutter 180 cuts the recording paper to cut the frame encircled the photographic image. Further, for example, in the event that the recording paper conveyed to the XY cutter 180 is of a size of photography derived from the sheet cassette 132, the XY cutter 180 carries out no cutting, and the recording paper is conveyed to a sorter 190. Further more, also in the event that photography is printed on a regular size of recording paper such as a postcard, the recording paper is conveyed directly to the sorter 190, which will be described later.

The recording papers, which are subjected to the processing such as the fixing and cutting as mentioned above, are conveyed and stacked in form of a photographic print to the sorter 190 that disposed at the final downstream end of the conveyance path. A stack of the recording papers to the sorter 190 is carried out in the manner as set forth below.

For example, when a block of recording papers obtained from a film is stored in a storage section 191 of the sorter 190, which is located at a predetermined storage position, the sorter 190 rotates in an arrow D direction, so that an empty storage section 191 moves to the storage position. And a block of recording papers is stored in the empty storage section 191. Thus, all blocks of recording papers are stored in the empty storage sections 191 with sorting for each block. The control section 110 controls the operation of the sorter 190.

Figure 2:
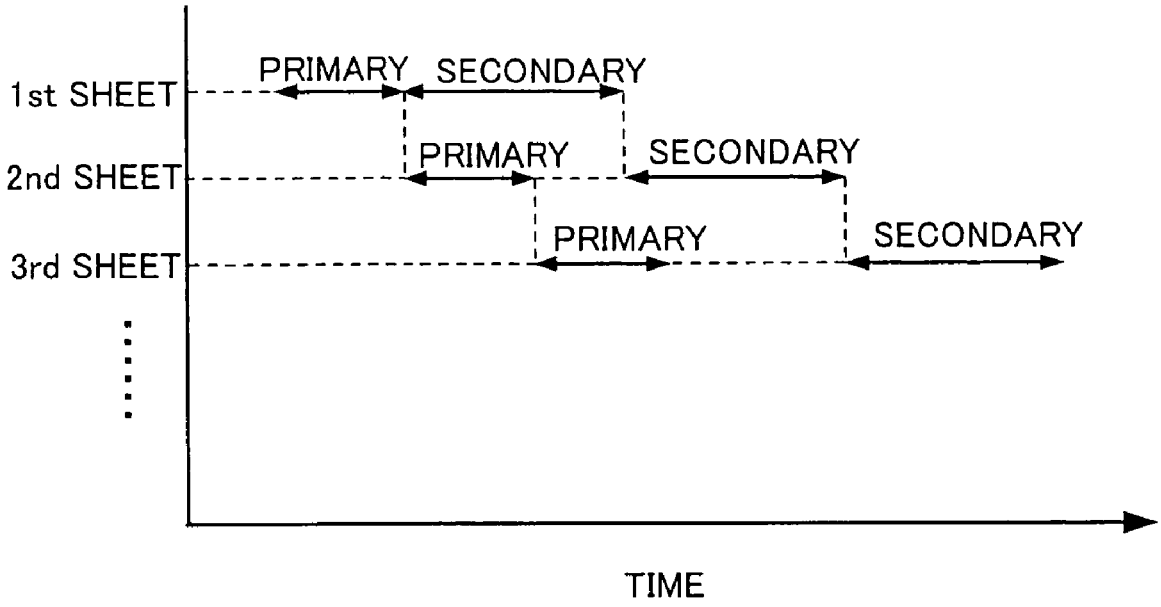
FIG. 2 is an explanatory view useful for understanding an example of processing of a primary fixing section and a secondary fixing section wherein processing is applied to a plurality of recording sheets in the printer shown in FIG. 1.

FIG. 2 is an explanatory view useful for understanding an example of processing of a primary fixing section and a secondary fixing section wherein processing is applied to a plurality of recording sheets in the printer shown in FIG. 1.

Here, now referring to FIG. 1 and FIG. 2, it will be explained that processing for high picture quality via processing of both the primary fixing section 140 and the secondary fixing section 170 is efficiently carried out for recording papers continuously conveyed.

For example, the primary fixing section 140 sequentially carries out processing for fixing a toner image on a recording paper, as shown in FIG. 2, for a first sheet, a second sheet, a third sheet, . . . . The recording papers, which are subjected to the processing of the primary fixing section 140, are stored in the storage section 160. The secondary fixing section 170 sequentially derives recording papers from the storage section 160 for a first sheet, a second sheet, a third sheet, . . . to apply a surface processing for smoothing a toner image of a recording paper to provide a gloss. In this manner, according to the printer 100 of the present embodiment, the processing of the primary fixing section 140 and the processing of the secondary fixing section 170 are carried out independently of one another, and thus it is possible to efficiently perform the processing of the primary fixing section 140 and the processing of the secondary fixing section 170 for the recording papers continuously conveyed.

Further, as mentioned above, with respect to types of the processing to be continuously carried out in the printer 100, it happens that there are mixed processing for high picture quality via the processing of both the primary fixing section 140 and the processing of the secondary fixing section 170 and processing for normal picture quality in which it is sufficient for the normal picture quality to provide only the processing of the primary fixing section 140.

Figure 3:
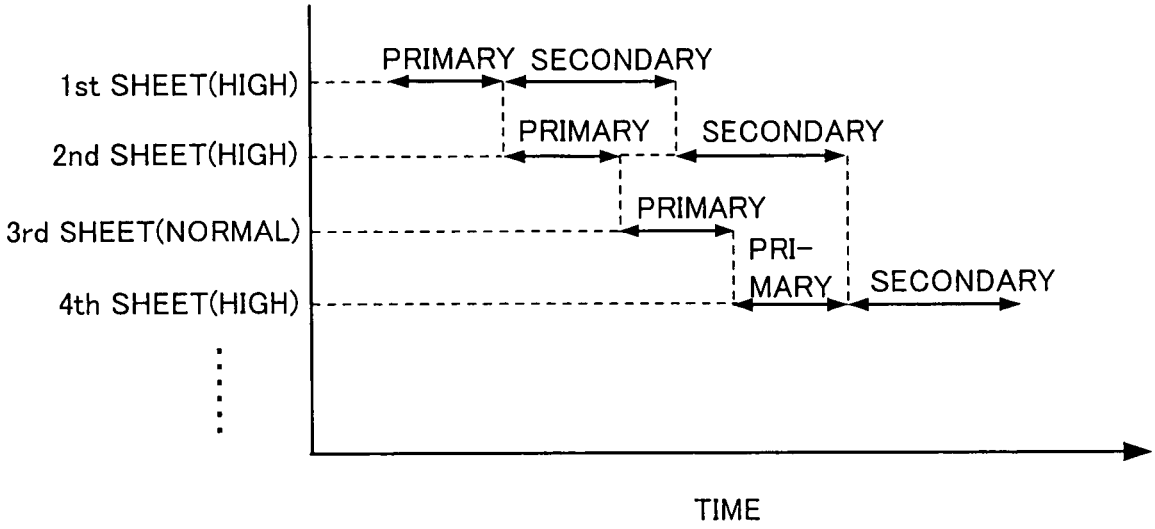
FIG. 3 is an explanatory view useful for understanding an example of processing of a primary fixing section and a secondary fixing section wherein processing for high picture quality and processing for normal picture quality are mixed.
Figure 4:
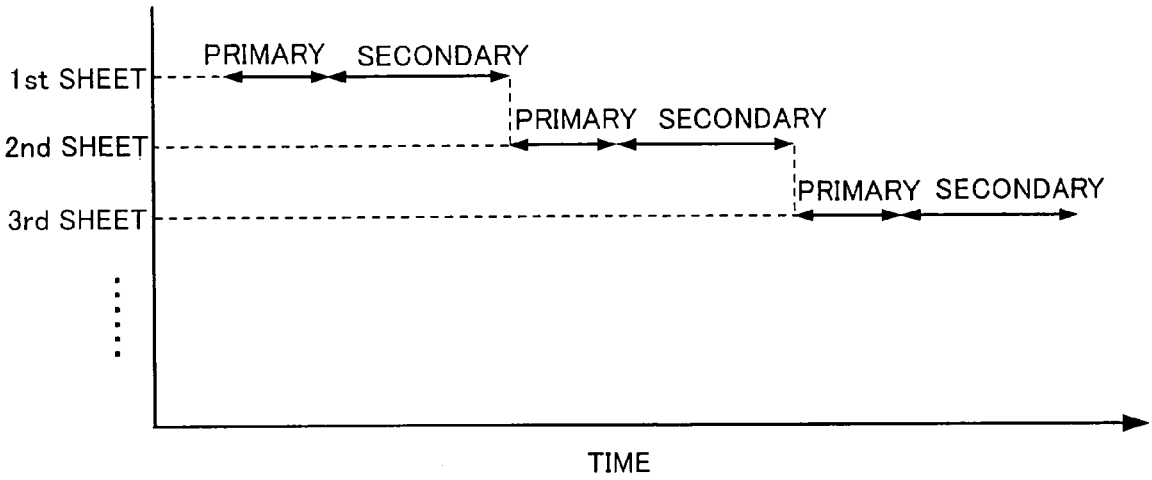
FIG. 4 is a view showing a typical example of a sequence consisting of the primary fixing and the secondary fixing for a plurality of recording media that are sequentially conveyed on a conveyance path, which is prevented from a collision on the conveyance path of two recording media continuously conveyed.

FIG. 3 is an explanatory view useful for understanding an example of processing of a primary fixing section and a secondary fixing section wherein c.

Here, referring to FIG. 1 and FIG. 3, it will be explained that processing for high picture quality via processing of both the primary fixing section 140 and the secondary fixing section 170 and processing for normal picture quality in which it is sufficient for the normal picture quality to provide only the processing of the primary fixing section 140 are efficiently carried out for recording papers continuously conveyed.

According to the example shown in FIG. 3, of the recording papers continuously conveyed, first, second and fourth recording papers are to be subjected to the processing for high picture quality, and third recording paper is to be subjected to the processing for normal picture quality. The primary fixing section 140 carries out processing for fixing a toner image on the recording paper, as shown in FIG. 3, for the first sheet, the second sheet, the third sheet, the fourth sheet, . . . , sequentially. Of the recording papers subjected to the processing by the primary fixing section 140, the first, second and fourth recording papers are guided by the guide section 150 to the first conveyance path L1 toward the storage section 160 so as to be stored in the storage section 160, and then the recording papers are derived from the storage section 160 so as to be subjected to the processing by the secondary fixing section 170. On the other hand, the third recording paper is guided by the guide section 150 to the second conveyance path L2 for making a detour to avoid the storage section 160 and a secondary fixing section 170 so as to be led along-the second conveyance path L2 to the XY cutter 180. In the XY cutter 180, the third recording paper is cut in compliance with the wishes of customers and then stacked onto the sorter 190.

The processing of the primary fixing section 140 and a series of processing for the third recording paper from the conveyance on the second conveyance path L2 to the stack onto the sorter 190, and the processing of the primary fixing section 140 for the first, second and fourth recording papers are carried out regardless of progress of the fixing processing of the secondary fixing section 170. Accordingly, even if it is concerned with a case where the secondary fixing section 170, it is possible to efficiently form an image.

According to the present embodiment, as an example of the secondary fixing section referred to in the present invention, there is raised an example in which the secondary fixing section performs the surface processing for smoothing a surface of the toner image of the recording paper to provide a gloss. However, it is noted that the present invention is not restricted to this embodiment. For example, it is acceptable that the secondary fixing section performs a mat processing in which a surface of the toner image is intentionally made opaque for the purpose of visual effects for a person looking the image. In this case, the secondary fixing belt of the secondary fixing section has a rough surface so-that a surface of the toner image is intentionally made opaque. Further, for example, it is acceptable that the secondary fixing section is one in which a surface of a toner image is processed as a relief consisting of a predetermined roughness. In this case, the secondary fixing belt of the secondary fixing section has a rough surface so that a surface of the toner image is processed as an intended relief.

Further, according to the present embodiment, as an example of the storage section referred to in the present invention, there is raised an example of the storage section in which recording papers sequentially conveyed are stored on a stacked basis, and when the recording papers are derived, the recording papers are derived first from the bottomed one in order. However, it is noted that the present invention is not restricted to this embodiment. For example, it is acceptable that the storage section is one in which recording papers sequentially conveyed are stored on a stacked basis, and when the recording papers are derived, the recording papers are derived first from the top one in order.

With the above-mentioned description the explanation of the first embodiment of the printer of the present invention will be terminated. Next, there will be explained second and third embodiments of a printer of the present invention. The second and third embodiments of a printer of the present invention are concerned with the first embodiment of a printer of the present invention in many points similar to the first embodiment. With respect to the second embodiment, however, there will be completely explained the structural elements and the operation. On the other hand, with respect to the third embodiment, only the difference from the second embodiment will be explained, in which the same parts are denoted by the same reference numbers as those of the second embodiment, to avoid the redundant description.

Figure 5:
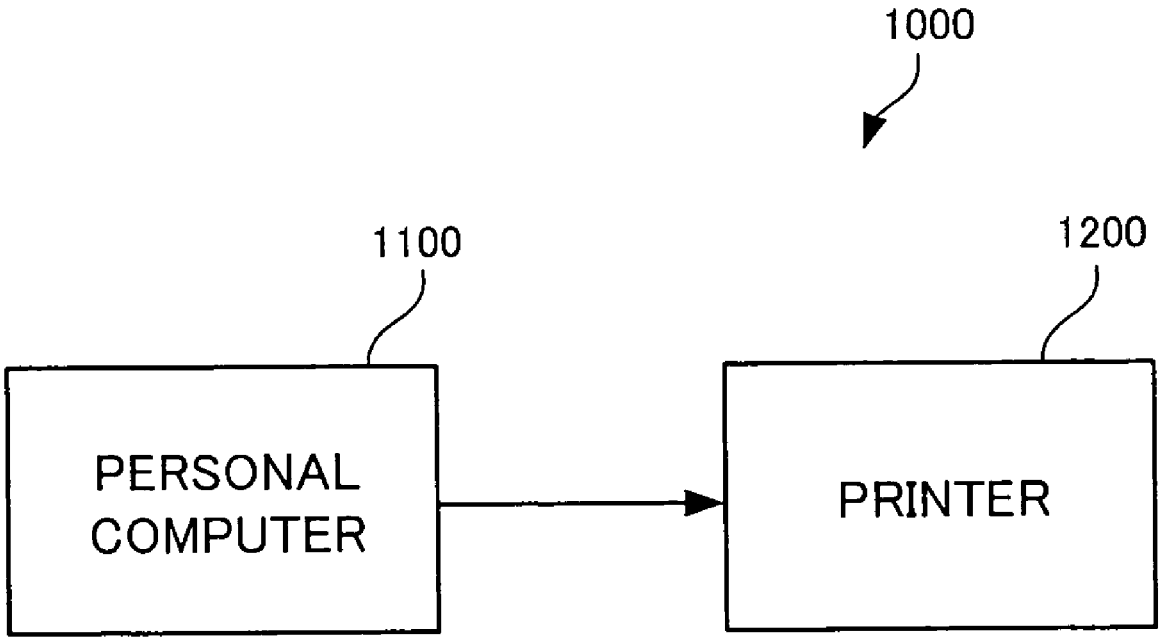
FIG. 5 is a view showing a print system to which second and third embodiments of the printer according to the present invention are applied.

FIG. 5 is a view showing a print system to which second and third embodiments of the printer according to the present invention are applied.

A print system 1000 shown in FIG. 5 comprises a personal computer 1100 that obtains image data from a film scanner (not illustrated) for reading photographic images recorded on a film, and a printer 1200 that forms an image on a sheet.

Figure 6:
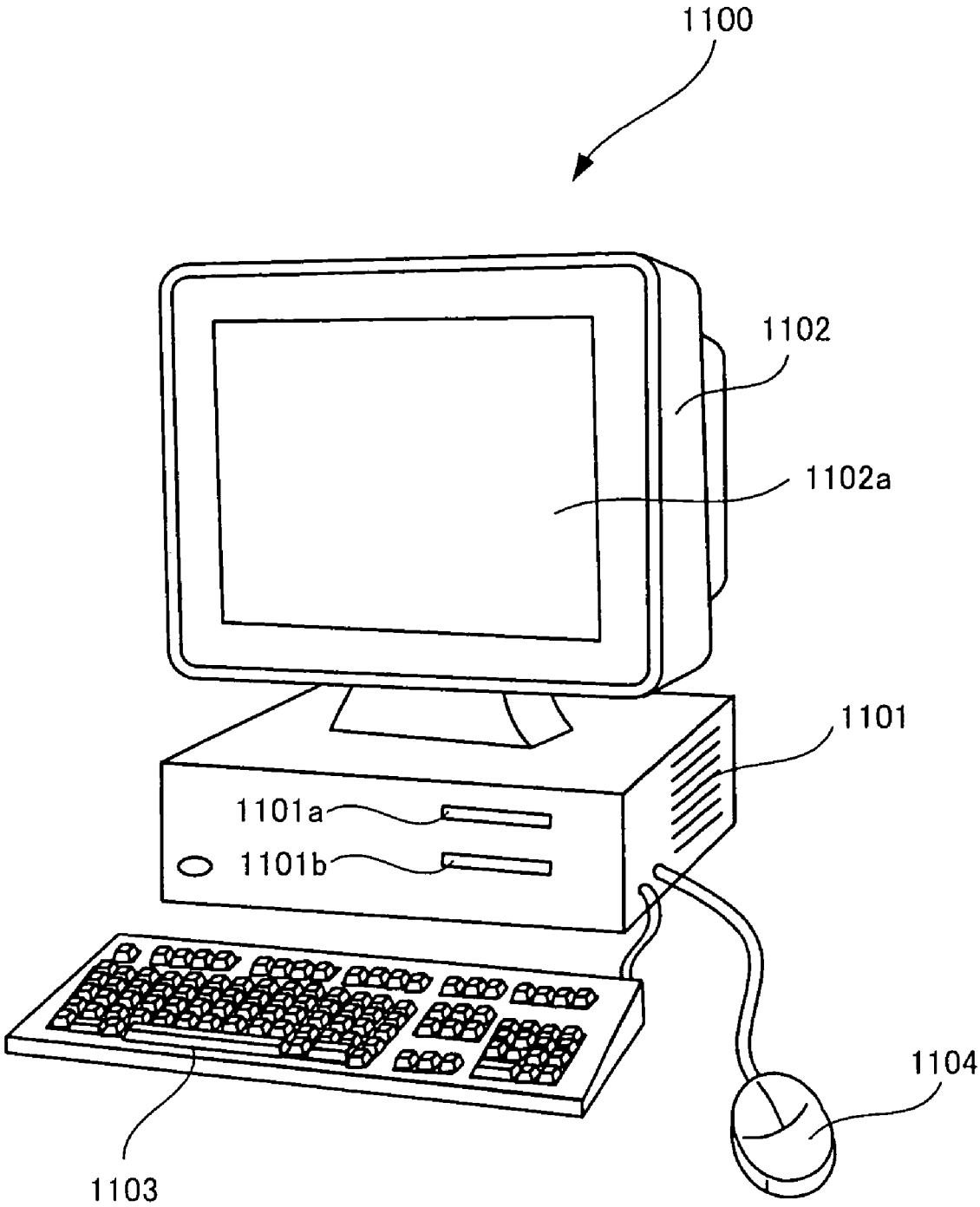
FIG. 6 is a perspective view of a personal computer shown in FIG. 5 with a block.
Figure 7:
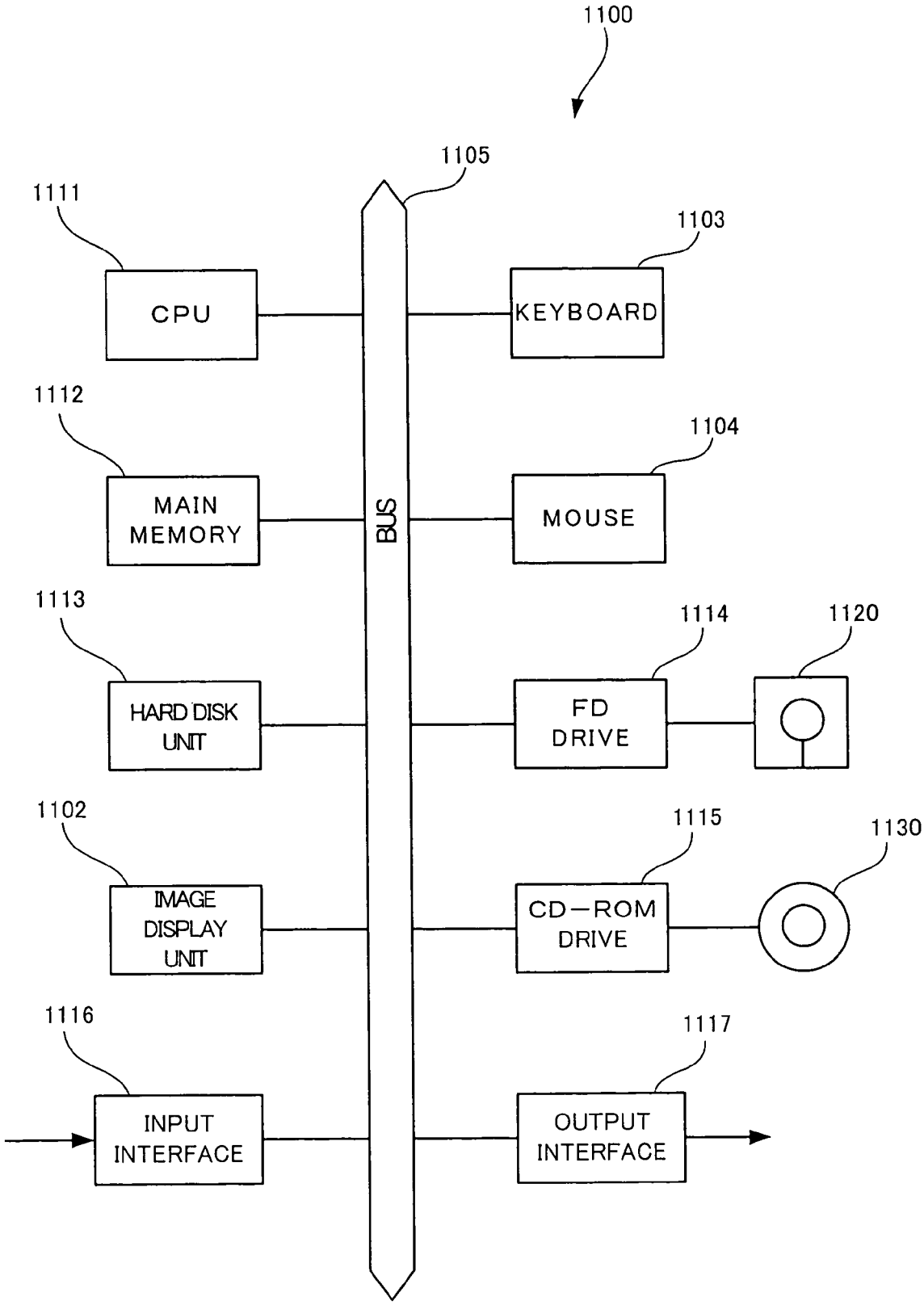
FIG. 7 is a hardware structural view of the personal computer shown in FIG. 6.

FIG. 6 is a perspective view of a personal computer shown in FIG. 5 with a block. FIG. 7 is a hardware structural view of the personal computer shown in FIG. 6.

The personal computer 1100 comprises, on an external appearance, a main frame unit 1101, an image display unit 1102 for displaying an image on a display screen 1102*a* in accordance with an instruction from the main frame unit 1101, a keyboard 1103 for inputting various sorts of information to the main frame unit 1101 in accordance with a key operation, and a mouse 1104 for inputting an instruction according to, for example, an icon and the like, through designation of an optional position on the display screen 1102*a*, the icon and the like being displayed on the position on the display screen 1102*a*. The main frame unit 1101 has a flexible disk (FD) mounting slot 1101*a* for mounting a flexible disk (FD), and a CD-ROM mounting slot 1101*b* for mounting a CD-ROM.

The main frame unit 1101 comprises, as shown in FIG. 7, a CPU 1111 for executing a various types of program, and for providing a various sorts of instructions instructed by an operator to the printer 1200 shown in FIG. 5, a main memory 1112 in which a program stored in a hard disk unit 1113 is read out and developed for execution by the CPU 1111, the hard disk unit 1113 for saving various types of programs and data, an FD drive 1114 for accessing a flexible disk 1120 mounted thereon, a CD-ROM drive 1115 for accessing a CD-ROM 1130 mounted thereon, an input interface 1116 for receiving image data from the color scanner (not illustrated) for reading photographic images recorded on a film, and an output interface 1117 for outputting image data to the printer 200. These various types of elements are connected via a bus 1105 to the image display unit 1102, the keyboard 1103 and the mouse 1104. The CPU 1111 corresponds to an example of the decision section in the printer of the present invention. The hard disk unit 1113 corresponds to an example of the storage section in the printer of the present invention. The image display unit 1102 corresponds to an example of the image display section in the printer of the present invention.

The personal computer 1100 shown in FIG. 5 transmits via the output interface 1117 shown in FIG. 7 to the printer 1200 image data representative of an image edited on the personal computer 1100 by an operator, photographic image data representative of a photographic image of the subject, which is received from the film scanner via the input interface 1116, and photographic image data recorded on the CD-ROM 1130 and a small type of recording medium (not illustrated). When an operator uses a set-up screen prepared beforehand to designate a sheet to be used, a print size and the number of outputted sheets, the CPU 1111 informs the printer 1200 of the set up contents. The printer 1200 performs a printing-out operation in accordance with image data transmitted from the personal computer 1100.

Figure 8:
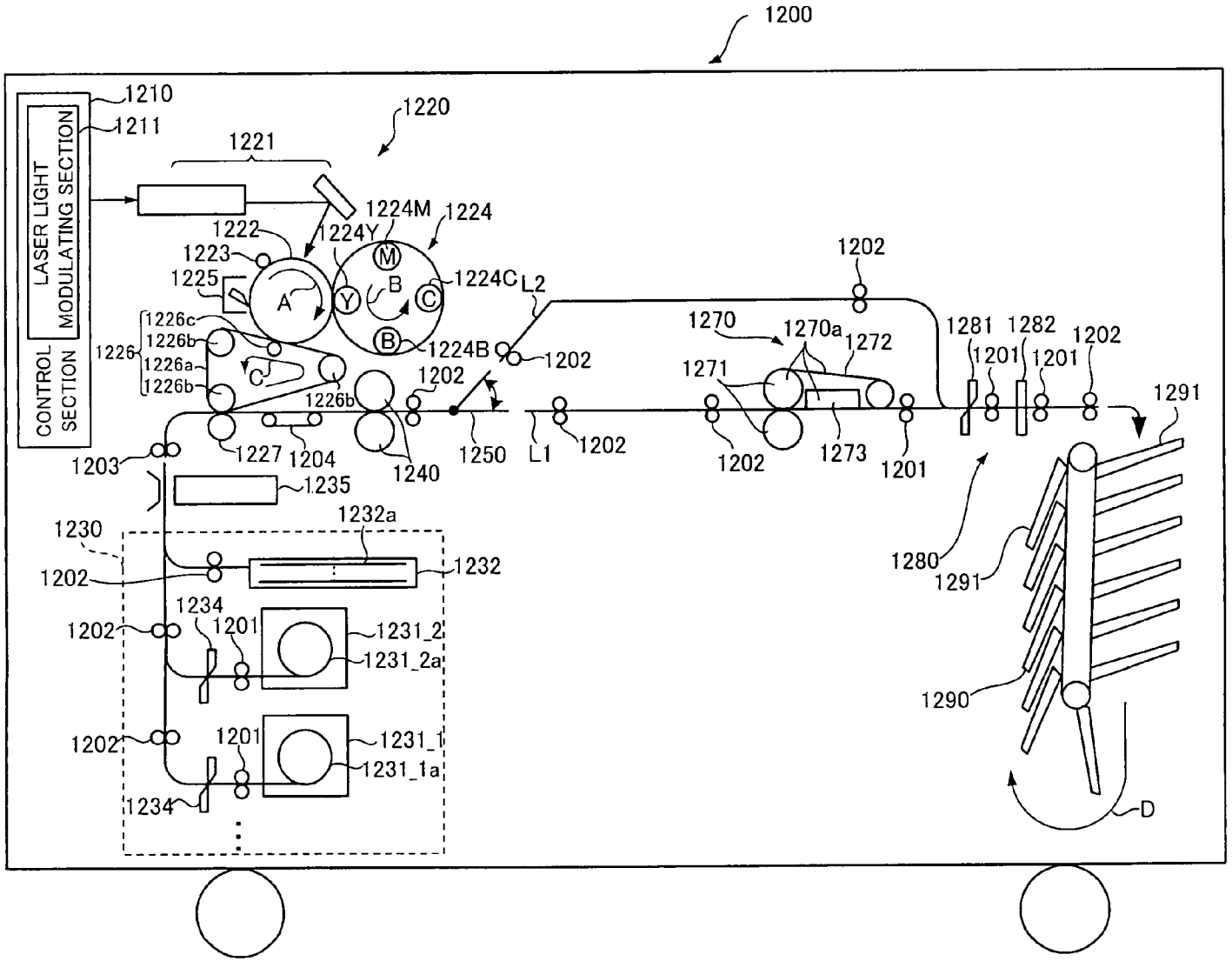
FIG. 8 is a schematic structural view showing main parts of the printer shown in FIG. 5.

FIG. 8 is a schematic structural view showing main parts of the printer shown in FIG. 5.

The printer 1200 is a printer adopting an electrophotographic system, in which there is formed an image, which consists of a fixed toner image on a recording medium, in such a manner that an electrostatic latent image is formed, a toner image is formed through a development of the electrostatic latent image with a toner, and the toner image is finally transferred and fixed onto the recording medium. Specifically, the printer 1200 has developing devices for each of colors of yellow (y), magenta (M), cyan (C), and black (B). According to the printer 1200, it is possible not only to print a monochromatic image, but also to print a full color of image consisting of toner images of four colors of yellow (y), magenta (M), cyan (C), and black (B).

The printer 1200 comprises a control section 1210 including a laser light modulation section 1211 for modulating a laser beam emitted from the laser in accordance with image data transmitted from the personal computer 1100, and an image forming section 1220 for transferring a toner image onto a sheet conveyed on a predetermined conveyance path. The image forming section 1220 corresponds to an example of the image forming section in the printer according to the present invention.

The image forming section 1220 comprises an exposure section 1221, an image carrier roll 1222, a charging roll 1223, a development unit 1224, a cleaner 1225, an intermediate transfer section 1226, and a secondary transfer roll 1227.

The image carrier roll 1222, which rotates in an arrow A direction, is charged in its surface by the charging roll 1223. The thus charged surface of the image carrier roll 1222 is scanning-exposed by the exposure section 1221 with laser beams modulated in accordance with image data transmitted from the personal computer 1100. Thus, there is formed an electrostatic latent image consisting of a predetermined surface potential on the surface of the image carrier roll 1222. The image carrier roll 1222 corresponds to an example of the image carrier roll referred to in the present invention.

The exposure section 1221 comprises a light source (not illustrated) such as a semiconductor laser, and an optical system for performing a scanning-exposure by leading laser beams emitted from the light source onto the image carrier roll 1222 in accordance with the image data from the personal computer 1100, the optical system comprising a polygon mirror, a reflection mirror and various sorts of lenses. The exposure section 1221 serves to write the electrostatic latent image onto the image carrier roll 1222.

The developing unit 1224 comprises developing devices 1224Y, 1224M, 1224C and 1224B for each of colors of yellow (y), magenta (M), cyan (C), and black (B), which are disposed at intervals of 90°. Any of the developing devices 1224Y, 1224M, 1224C and 1224B adopts a so-called magnetic brush development scheme, and accommodates therein two-component developer including a toner and a carrier. The developing unit 1224 rotates in an arrow B direction at intervals of intervals of 90°, so that any one of the developing devices 1224Y, 1224M, 1224C and 1224B closely faces the image carrier roll 1222 keeping a predetermined minute distance. The developing device, which closely faces the image carrier roll 1222, causes a toner to adhere on an electrostatic basis to the electrostatic latent image formed on-the surface of the image carrier roll 1222 in accordance with the magnetic brush effect, so that a toner image of a color associated with the developing device is formed on the surface of the image carrier roll 1222.

The intermediate transfer section 1226 is constructed in such a manner that an intermediate transfer belt 1226*a* is constructed movably in an arrow C direction by catenary rolls 1226*b*. A primary transfer roll 1226*c* is disposed at a primary transfer position in which the intermediate transfer belt 1226*a* is closely contact with the image carrier roll 1222. The primary transfer roll 1226*c* applies a transfer voltage to the intermediate transfer belt 1226*a*. The toner image, which is formed on the surface of the image carrier roll 1222 by the developing devices 1224Y, 1224M, 1224C and 1224B incorporated into the developing unit 1224, is transferred to the intermediate transfer belt 1226*a* by the transfer voltage at the primary position.

In the event that an image now to be formed is a color image, first, the exposure section 1221 forms an electrostatic latent image for yellow (Y) on the surface of the image carrier roll 1222. A toner is absorbed into the electrostatic latent image from the developing device 1224Y for yellow closely facing the image carrier roll 1222 by rolling of the developing unit 1224, so that a toner image of yellow is formed on the surface of the image carrier roll 1222. The toner image of yellow is transferred to the intermediate transfer belt 1226*a*. Thereafter, the exposure section 1221 forms an electrostatic latent image for magenta (M) on the surface of the image carrier roll 1222, which is removed in the residual toner on its surface by the cleaner 1225. At that time, a toner is absorbed into the electrostatic latent image from the developing device 1224M for magenta closely facing the image carrier roll 1222 by rolling of the developing unit 1224 by 90°, so that a toner image of magenta is formed on the surface of the image carrier roll 1222. The toner image of magenta is transferred to the intermediate transfer belt 1226*a* in such a manner that the toner image of magenta is superposed on the toner image of yellow, which is already transferred. Hereinafter, in a similar fashion, toner images of the remaining cyan (C) and black (B) are sequentially transferred onto the intermediate transfer belt 1226*a*. A control section 1210 controls the catenary rolls 1226*b* for moving the intermediate transfer belt 1226*a* so that the toner images for the respective colors, which are sequentially transferred, are exactly overlapped with one another.

In the event that an image now to be formed is a monochromatic image, in a similar fashion to that of the color image, only the toner of black (B) is transferred to the intermediate transfer belt 1226*a*.

The toner image transferred via the above-mentioned operation to the intermediate transfer belt 1226*a* is further transferred to a sheet-like shaped recording medium conveyed from a sheet supplying section 1230, which will be explained later, by the secondary transfer roll 1227 disposed over against one of the catenary rolls 1226*b* via the intermediate transfer belt 1226*a*. As a result, a toner image of color or a monochromatic toner image is formed on the surface of the recording medium.

Next, there will be explained the sheet supplying section 1230 for supplying the sheet-like shaped recording medium to the image forming section 1220, which the printer 1200 shown in FIG. 1 is provided with.

The sheet supplying section 1230 stores three types of sheets of two sorts of roll paper and one sort of cut sheet. A roll paper storage section $\mathbf{1231}_{13}$ 1 is loaded with a first roll paper 1231_1*a*. A roll paper storage section 1231_2 is loaded with a second roll paper 1231_2*a*. A cut sheet supplying section 1232 is loaded with a cut sheet 1232*a*. While FIG. 8 shows two roll paper storage section 1231_1 and roll paper storage section 1231_2, and one cut sheet supplying section 1232 by way of example, the present invention is not restricted to this embodiment. It is acceptable that-a printer of the present invention is provided with three or more roll paper storage sections to be loaded with roll papers, which are different from one another in size in a width direction and a sort, and cut sheet supplying sections.

Upon receipt of information of the sheet designated by an operator from the CPU 1111, the control section 1210 causes the sheet supplying section 1230 to convey the designated sheet to the image forming section 1220.

In the event that the designated sheet is the first roll paper 1231_1*a* or the second roll paper 1231_2*a*, the roll papers are drawn out by positioning rolls 1201, which are provided in the vicinity of roll paper taking out slots of the roll paper storage sections 1231_1 and 1231_2, respectively, and are conveyed to roll paper cutters 1234, which are disposed at the downstream side of the positioning rolls 1201 in the conveyance path for the sheets. After the first roll paper 1231_1*a* or the second roll paper 1231_2*a* is subjected to the positioning by the positioning roll 1201, the first roll paper 1231_1*a* or the second roll paper 1231_2*a* is cut by the roll paper cutter 1234 into a predetermined size. The positioning rolls 1201 are controlled by the control section 1210 so that the positioning rolls 1201 make a positioning of the first roll paper 1231_1*a* or the second roll paper 1231_2*a* in accordance with a size of a sheet to be cut.

The sheet-like shaped sheets, which are cut out from the roll paper storage section 1231_1 and roll paper storage section 1231_2, are conveyed by a plurality of conveyance rolls 1202 disposed at several places on the conveyance path that is formed with the plurality of conveyance rolls 1202 in the printer 1200.

In the event that the sheet designated by an operator is the cut sheet 1232*a*, the cut sheet 1232*a* is taken out by the conveyance roll 1202, which is provided in the vicinity of a sheet taking out slot of the cut sheet supplying section 1232, and is conveyed to the downstream side in the conveyance path.

The conveyance paths from the roll paper cutters 1234 and the conveyance path from the cut sheet supplying section 1232 are combined into a single conveyance path at the downstream side. On the single conveyance path, there is disposed a printing head 1235 for printing various sorts of print information on a blank of the conveyed sheet. The print information printed by the printing head 1235 includes, for example, information such as various sorts of set up parameters in image forming set up by an operator, as well as a frame number indicative of correspondence of an image to be printed on the recording paper to an image on a film, and date of the photography of the image.

A resist roll 1203, which is disposed at the downstream side with respect to the printing head 1235, conveys the sheet subjected to printing onto the blank by the printing head 1235 to the secondary transfer roll 1227 of the image forming section 1220, which is located at the further downstream side of the conveyance path, in accordance with timing (which will be described later). The secondary transfer roll 1227 transfers color or monochromatic toner image, which is already formed on the intermediate transfer belt 1226*a*, onto the sheet thus conveyed.

As mentioned above, in the event that the toner image of color is formed on the intermediate transfer belt 1226*a*, the intermediate transfer belt 1226*a* rotatably moves four times in an arrow C direction so that toner images of YMCB four colors are transferred onto the intermediate transfer belt 1226*a* one by one in color whenever the intermediate transfer belt 1226*a* rotates once. According to the present embodiment, in the event that the toner image of color is formed on the intermediate transfer belt 1226*a*, a conveyance of the sheet to the secondary transfer roll 1227 by the resist roll 1203 is carried out in such a manner that the sheet is conveyed to the secondary transfer roll 1227 in timing that the toner image of color formed on the intermediate transfer belt 1226*a* through transfer of toner images of all four colors first faces the secondary transfer roll 1227. The control section 1210 controls the resist roll 1203 so as to perform a conveyance of the sheet in the timing as mentioned above.

In the manner as mentioned above, the sheet, onto which the toner image is transferred, is conveyed via a conveyance belt 1204 disposed at the downstream side of the secondary transfer roll 1227 to a primary fixing section 1240 that is disposed at the further downstream side of the conveyance path. The primary fixing section 1240 applies heating and pressure processing to the sheet, onto which the toner image is transferred, so that the toner image is fixed on the sheet. The primary fixing section 1240 corresponds to an example of the primary fixing section in a printer of the present invention. An image, which is obtained through fixing of the toner by the primary fixing section 1240, has an image quality equivalent to that of an image obtained by a color copying machine and the like, while it falls short of high picture quality required for photographic image and the like.

The sheet, which is subjected to the processing by the primary fixing section 1240, is conveyed to a guide section 1250 disposed at the downstream side of the primary fixing section 1240 in the conveyance path.

The guide section 1250 distributes sheets to a first conveyance path L1 toward a secondary fixing section 1270 (which will be explained later) and a second conveyance path L2 for making a detour to avoid the secondary fixing section 1270. The first conveyance path L1 is for applying to a sheet a surface processing to obtain a photographic image level of high picture quality. The second conveyance path L2 is for leading the sheet passing through the primary fixing section 1240 to the output side of the printer 1200 directly, omitting the processing as mentioned above with respect to the first conveyance path L1. The first conveyance path L1 corresponds to an example of the first conveyance path referred to in the present invention. The second conveyance path L2 corresponds to an example of the second conveyance path referred to in the present invention.

The sheet, which is subjected to the primary fixing so that a toner image is formed on its surface, is guided to any one of the first conveyance path L1 and the second conveyance path L2. Regarding a selection between the first conveyance path L1 and the second conveyance path L2 in guidance, the CPU 1111 shown in FIG. 7 decides it in accordance with sheet sorts and print sizes designated by an operator. The decision way will be described later.

A decision result decided by the CPU 1111 is transmitted to the control section 1210 shown in FIG. 8. The control section 1210 causes the guide section 1250 to guide the sheet to the path according to the decision result, of the first conveyance path L1 and the second conveyance path L2.

The sheet guided to the first conveyance path L1 is conveyed to the secondary fixing section 1270 that is disposed on the first conveyance path L1.

The secondary fixing section 1270 corresponds to an example of the secondary fixing section referred to in the present invention. The secondary fixing section 1270 comprises a surface processor 1270*a*, a positioning roll 1201 and a conveyance roll 1202. The surface processor 1270*a* is mounted which is exchangeable for a plurality of types of surface processor according to sizes and sorts of surface processing. The surface processor 1270*a* comprises a heating and pressure rolls 1271 for applying the heating and pressure processing to the conveyed sheet, a secondary fixing belt 1272 having a surface according to a sort of surface processing, the secondary fixing belt 1272 circularly moving, and a cooler 1273 for cooling the sheet heated by the heating and pressure rolls 1271. The surface processor 1270*a* corresponds to an example of the surface processor referred to in the present invention.

In the secondary fixing section 1270, first, the heating and pressure rolls 1271 heat and fuse the toner image fixed on the sheet in the primary fixing section 1240, and press the surface of the fused toner image against the smooth glossy surface of the secondary fixing belt 1272. The sheet is conveyed to the downstream side in the state that the recording paper is sticking to the glossy surface of the secondary fixing belt 1272. The sheet, which is sticking to the glossy surface, is cooled by the cooler 1273 disposed at the downstream of the heating and pressure rolls 1271. Thus, the toner image fused on the sheet is solidified. Thereafter, the sheet is conveyed to the further downstream side, and is separated from the glossy surface of the secondary fixing belt 1272 by rigidity of the sheet itself as the secondary fixing belt 1272 is flexible.

The surface of the sheet is formed with a transparent resin layer. After the sheet is subjected to the processing by the primary fixing section 1240, the surface of the sheet offers a state that a toner image is fixed on the resin layer. In this condition, when the sheet is subjected to the processing by the secondary fixing section 1270, the resin layer and the toner image are fused together, so that both the resin layer and the toner image are united with one another and the surface of the sheet is pressed on the glossy surface of the secondary fixing belt 1272 and is solidified. This processing by the secondary fixing section 1270 makes it possible to a high picture quality of image having a gloss, which is not worse than the photographic image.

The first conveyance path L1 and the second conveyance path L2 for making a detour to avoid the secondary fixing section 1270 are combined into a single path at the downstream side of the secondary fixing section 1270. An XY cutter 1280 is disposed at the further downstream side of the single path. The sheet is conveyed via the secondary fixing section 1270 or the second conveyance path L2 to the XY cutter 1280.

The XY cutter 1280 comprises a first cutter 1281 for cutting the sheet vertically with respect to the conveyance direction, and a second cutter 1282 for cutting the sheet along the conveyance direction. The first cutter 1281 and the second cutter 1282 are disposed in series on the conveyance path. Positioning rolls 1201 are disposed between the first cutter 1281 and the second cutter 1282, and at the downstream side of the second cutter 1282, respectively. Those positioning rolls 1201 perform the positioning of the sheet for the XY cutter 1280. The control section 1210 controls the positioning rolls 1201 to perform the positioning of the sheet.

The cutting of the sheet by the XY cutter 1280 is carried out by set up of an operator in compliance with the wishes of customers. For example, in the event that the sheet conveyed to the XY cutter 1280 is one cut out from roll papers 1231_1*a* and 1231_2*a*, and a size of the sheet cut out from the roll papers 1231_1*a* and 1231_2*a* is larger somewhat than the photographic size, the XY cutter 1280 carries out the cutting in accordance with the photographic size. Further, for example, in the event that the sheet conveyed to the XY cutter 1280 is of a size of photography derived from the cut sheet supplying section 1232, the XY cutter 1280 carries out no cutting, and the sheet is conveyed to a sorter 1290, which will be described later. Further more, also in the event that photography is printed on a regular size of sheet such as a postcard, the sheet is conveyed directly to the sorter 1290, which will be described later.

The sheets, which are subjected to the processing such as the fixing and cutting as mentioned above, are conveyed and stacked to the sorter 1290 that disposed at the final downstream end of the conveyance path. A stack of the recording papers to the sorter 1290 is carried out in the manner as set forth below.

For example, when a block of sheets obtained from a film is stored in a storage section 1291 of the sorter 1290, which is located at a predetermined storage position, the sorter 1290 rotates in an arrow D direction, so that an empty storage section 1291 moves to the storage position. And a block of sheets is stored in the empty storage section 1291. Thus, all blocks of sheets are stored in the empty storage sections 1291 with sorting for each block. The control section 1210 controls the operation of the sorter 1290.

A series of image forming processing, as mentioned above, makes it possible to form a high picture quality of image on a sheet.

It is noted that the surface processor 1270*a* shown in FIG. 8 is mounted which is exchangeable for a plurality of types of surface processor FIG. 9 is an explanatory view useful for understanding sorts of detachable surface processors as the surface processor shown in FIG. 8.

As the surface processor 1270*a* shown in FIG. 8, according to this example, it is possible to mount five types of surface processors, which are different from one another in sorts of surface processing (glossy, raster, mat, silk, and special pattern) and the maximum size of sheets allowed in surface processing. To the respective surface processors, ID's (ID_01 to ID_05) are applied. When the respective surface processor is mounted to the secondary fixing section 1270, the ID, which is applied to the associated surface processor, is transmitted to the CPU 1111 shown in FIG. 7. A way of reading the ID applied to the surface processor is well known and thus detailed explanations will be omitted. It is noted, however, that there is known, for example, a method in which a photo interrupter is used to read bit holes according to the ID, which is provided on the surface processor.

The surface processors shown in FIG. 9 cannot perform processing of a surface processing for all the roll paper 1231_1*a*, the roll paper 1231_2*a* and the cut-sheet 1232*a* shown in FIG. 8, and are sorted out into available one and unavailable one in accordance with paper quality and size of sheets. The hard disk unit 1113 shown in FIG. 5 previously stores an association between the surface processors and sheets capable of being subjected to surface processing by the surface processors.

FIG. 10 is an explanatory view useful for understanding an association between the surface processors and sheets capable of being subjected to surface processing by the surface processors.

For example, for a cut sheet (the cut sheet 1232*a*), only the surface processing of the gloss processing is allowed to be carried out, and thus the cut sheet is associated with the surface processor of the surface processor ID_01 for the gloss processing. Likely, a first roll paper (the roll paper 1231_1*a*) with the surface processor of the surface processor ID_02; the first roll paper and a second roll paper (the roll paper 1231_2*a*) with the surface processor of the surface processor ID_03; the first roll paper and the second roll paper with the surface processor of the surface processor ID_04; and the first roll paper with the surface processor of the surface processor ID_05.

Figure 11:
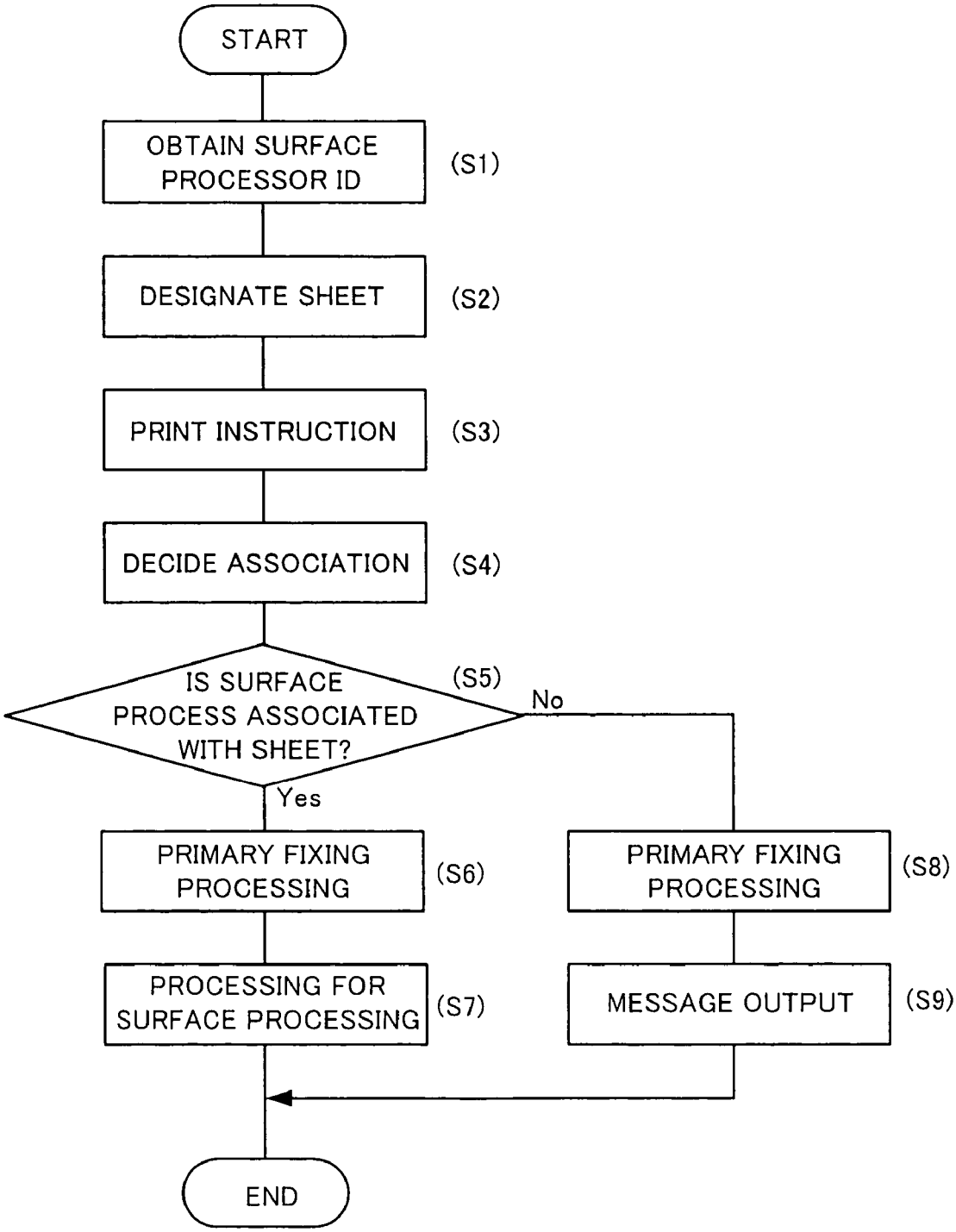
FIG. 11 is a flowchart useful for understanding a series of processing from mounting the surface processor shown in FIG. 8 on the secondary fixing section up to forming an image on a sheet.

FIG. 11 is a flowchart useful for understanding a series of processing from mounting the surface processor shown in FIG. 8 on the secondary fixing section up to forming an image on a sheet. Hereinafter, there will be explained a series of processing to form an image on a sheet designated by an operator using the flowchart.

First, an operator mounts one of the surface processors shown in FIG. 9 on the secondary fixing section 1270 shown in FIG. 8. According to the present embodiment, it is assumed that the surface processor of the surface processor ID_02 is mounted as the surface processor 1270*a*.

When the surface processor 1270*a* is mounted, the surface processor ID (ID_02) of the surface processor 1270*a* is read by a photo interrupter (not illustrated), and the surface processor ID thus read is informed the CPU 1111 shown in FIG. 7 (step S1 in FIG. 11).

Next, the operator selects an image for print out using a set-up screen prepared beforehand, and designates a sort of the sheet for print out, a print size and a number of printing sheets (step S2 in FIG. 11). The values thus designated are informed the CPU 1111.

Further, the operator selects a print instruction button (not illustrated) through the mouse 1104 and the like to instruct a print output (step S3 in FIG. 11).

When the operator designates the print output, the CPU 1111 obtains the association stored in the hard disk unit 1113 to decides whether the sort of the designated sheet corresponds to the surface processor ID (ID_02) informed from the printer 1200 (step S4 in FIG. 11).

First, there will be explained an example in which an operator designates first roll paper 1231_1*a*.

In the association shown in FIG. 10, the surface processor ID_02 is associated with the first roll paper 1231_1*a*. The CPU 1111 decides that the surface processor 1270*a* mounted on the printer 1200 is associated with the sort of the sheet selected by the operator. In the flowchart of FIG. 11, the process goes from step S5 to step S6.

When the decision processing is terminated, the CPU 1111 transmits to the control section 1210 shown in FIG. 8 image data representative of an image designated by the operator, information representative of the designated sheet, and the decision result.

The control section 1210 causes the image forming section 1220 to perform a series of image formation processing in accordance with the image data transmitted from the CPU 1111. Further, the control section 1210 causes the positioning rolls 1201 of the roll paper storage section $\mathbf{1231}_{13\ 1}$ to take out the roll paper 1231_1*a* designated by the operator, and causes the roll paper cutter 1234 to cut the roll paper 1231_1*a*. The cut roll paper 1231_1*a* is conveyed to the downstream in the conveyance path. A toner image is transferred onto the sheet (the cut sheet of the roll paper 1231_1*a*) conveyed on the conveyance path, in accordance with a series of processing as mentioned above. The primary fixing section 1240 fixes the toner image (step S6 in FIG. 11).

The control section 1210 controls the guide section 1250 in accordance with a decision result (an association between the sheet and the surface processor) transmitted from the CPU 1111 to guide the sheet subjected to the primary fixing onto the first conveyance path L1 toward the secondary fixing section 1270.

The surface processor 1270*a* applies a surface processing for the suitable gloss processing to the sheet conveyed to the secondary fixing section 1270 (step S7 in FIG. 11).

The sheet subjected to the surface processing is conveyed to the XY cutter 1280 and is cut into a designated size.

Thus, in the event that the sheet selected by the operator is associated with the sort of the surface processor mounted on the secondary fixing section, it is possible to obtain an image to which a surface processing according to the surface processor is applied.

Next, there will be explained an example in which an operator designates the second roll paper 1231_2*a*.

In the association shown in FIG. 10, the surface processor ID_02 is associated with the second roll paper. In this case, the CPU 1111 decides that the surface processor 1270*a* mounted on the printer 1200 is not associated with the sort of the sheet selected by an operator. In this case, in the flowchart of FIG. 11, the process goes from the step S5 to step S8.

When the decision processing is terminated, the CPU 1111 transmits to the control section 1210 shown in FIG. 8 image data representative of an image designated by the operator, information representative of the designated sheet, and the decision result.

The control section 1210 causes the positioning rolls 1201 of the roll paper storage section 1231_2 to take out the roll paper 1231_2*a* designated by the operator, and causes the roll paper cutter 1234 to cut the roll paper $\mathbf{1231}_{13}$ 2*a*. The cut roll paper 1231_2*a* is conveyed to the downstream in the conveyance path. A toner image is transferred onto the sheet (the cut sheet of the roll paper $\mathbf{1231}_{13}$ 2*a*) conveyed on the conveyance path, in accordance with a series of processing as mentioned above. The primary fixing section 1240 fixes the toner image (step S8 in FIG. 11).

The control section 1210 controls the guide section 1250 in accordance with a decision result (non-association between the sheet and the surface processor) transmitted from the CPU 1111 to guide the sheet subjected to the primary fixing onto the second conveyance path L2 for making a detour to avoid the secondary fixing section 1270. The sheet guided to the second conveyance path L2 is conveyed to the XY cutter 1280 so as to be cut into the designated size, without being subjected to processing for the surface processing.

At that time, the CPU 1111 shown in FIG. 7 causes the image display unit 1102 to display a message "no processing for surface processing is performed" on the display screen 1102*a* (step S9 in FIG. 11).

In this manner, according t o the print system 1000 of the present embodiment, there is previously stored an association between a sort of surface processors and a sort of sheets capable of being subjected to surface processing by the surface processors, and it is decided in accordance with the association whether the surface processing is carried out or not. Accordingly, even if an operator does not know a sort of sheets available in the surface processor, it is possible to prevent such an in convenience that the surface processing is inadvertently applied to the selected sheet, and thereby avoiding waste of sheets and processing times.

Here, an explanation of the second embodiment of the printer of the present invention will be terminated. Next, there will be explained a third embodiment of a printer of the present invention. As mentioned above, in the third embodiment, the same parts are denoted by the same reference numbers as those of the second embodiment, and different points from the second embodiment will be explained.

Figure 12:
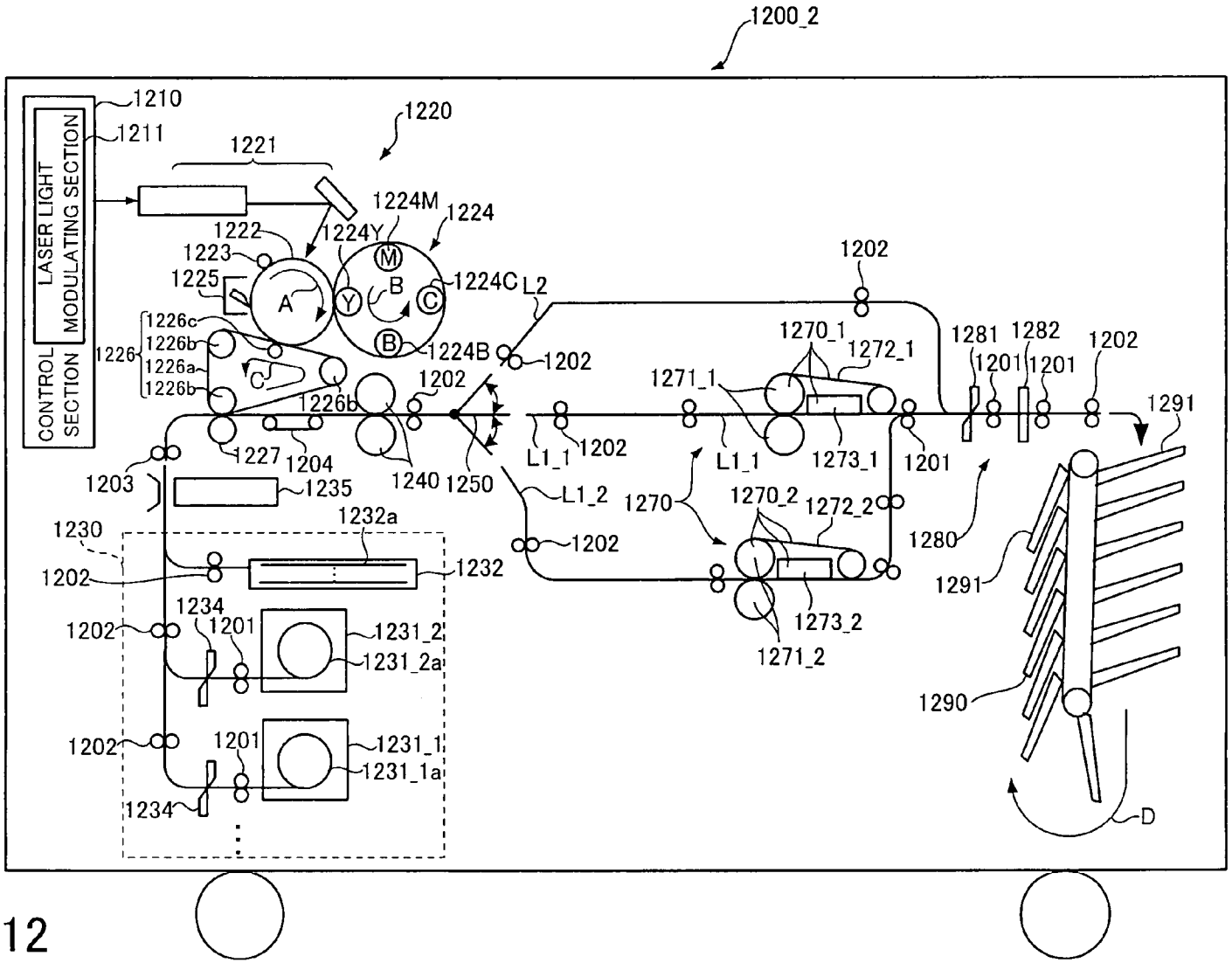
FIG. 12 is a schematic structural view showing main parts of the printer which is applied to the third embodiment.

FIG. 12 is a schematic structural view showing main parts of the printer which is applied to the third embodiment.

A printer 1200_2 according to the present embodiment shown in FIG. 12 comprises the substantially same structure elements as the printer 1200 according to the second embodiment shown in FIG. 8, excepting that the secondary fixing section 1270 of the present embodiment comprises two surface processors of a surface processor 1270_1 and a surface processor 1270_2, instead of the surface processor 1270*a* of the secondary fixing section 1270 in FIG. 8. Those surface processor 1270_1 and surface processor 1270_2 also comprise, in a similar fashion to that of the surface processor 1270*a* of the second embodiment, heating and pressure rolls 1271_1 and 1271_1, secondary fixing belts 1272_1 and 1272_2, and coolers 1273_1 and 1273_2, respectively. And those surface processors are exchangeable with various sorts of processors set forth in FIG. 9. Further, according to the present embodiment, the sheets supplied from the sheet supplying section 1230 are guided by the guide section 1250 through a distribution to a conveyance path L1_1 toward the surface processor 1270_1, a conveyance path L1_2 toward the surface processor 1270_2, a conveyance path L2 for making a detour to avoid the surface processor 1270_1 and the surface processor 1270_2. The conveyance path L1_1 and the conveyance path L1_2 correspond to an example of the branch path referred to in the present invention.

Figure 13:
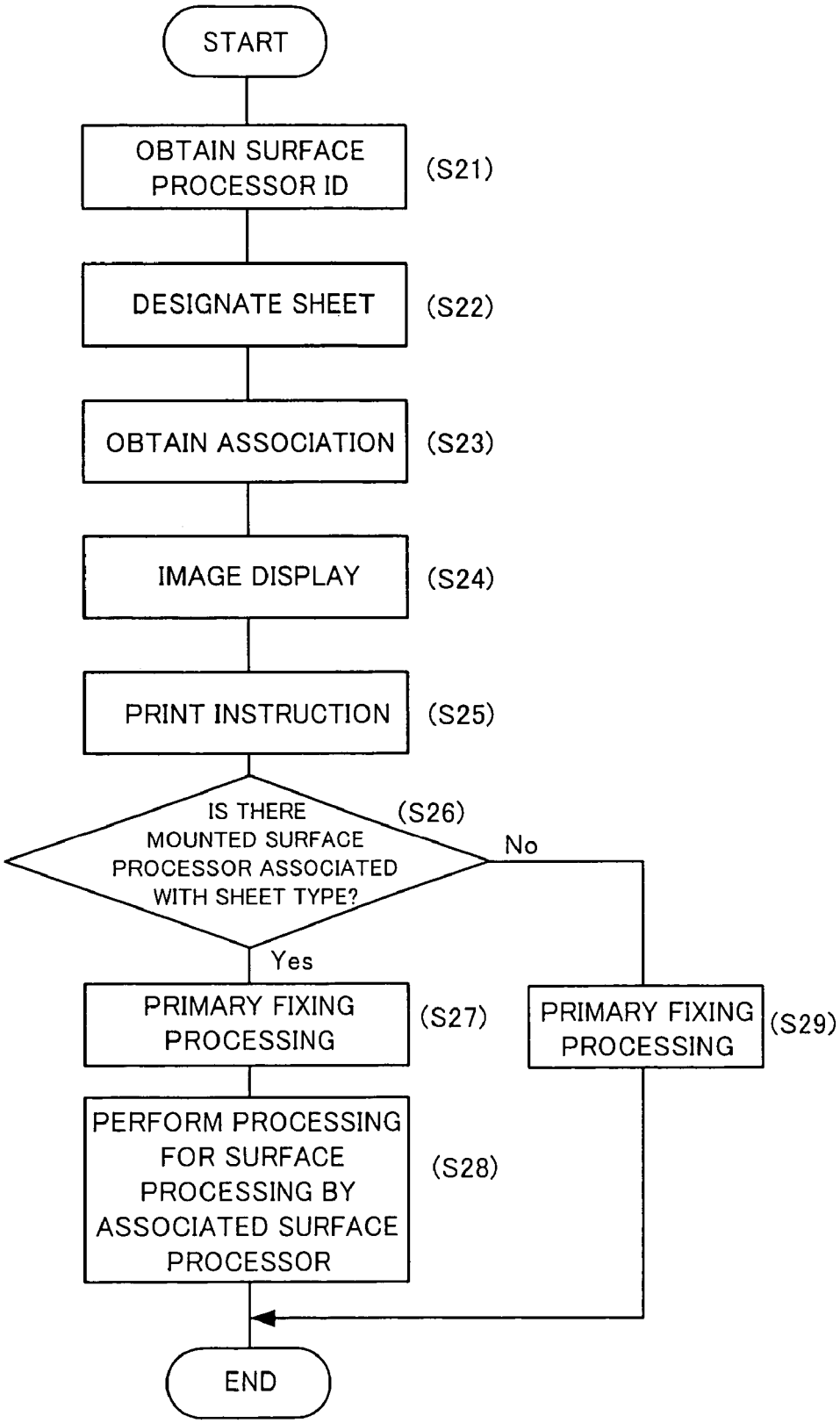
FIG. 13 is a flowchart useful for understanding a series of processing up to forming an image on a sheet in a. printer system according to the third embodiment.

FIG. 13 is a flowchart useful for understanding a series of processing up to forming an image on a sheet in a printer system according to the third embodiment.

First, in similar fashion to that of the second embodiment, an operator mounts two of the surface processors shown in FIG. 9 on the secondary fixing section 1270 shown in FIG. 12. According to the present embodiment, it is assumed that the surface processor of the surface processor ID_01 is mounted as the surface processor 1270_1 and the surface processor of the surface processor ID_02 is mounted as the surface processor 1270_02.

When the surface processor 1270_1 and the surface processor ID_02 are mounted, in similar fashion to that of the step S1 in FIG. 11, the surface processors ID (ID_01, ID_02) of the surface processor 1270_1 and the surface processor ID_02 are read by a photo interrupter (not illustrated), and the surface processors ID thus read are informed the CPU 1111 shown in FIG. 7 (step S21 in FIG. 13).

Next, the operator selects an image for print out using a set-up screen prepared beforehand, and designates a sort of the sheet for print out, a print size and a number of printing sheets (step S22 in FIG. 13).

When the operator designates the print output, the CPU 1111 obtains the association stored in the hard disk unit 1113 to decides whether the sort of the designated sheet is associated with the surface processors ID (ID_01, ID_02) of the surface processors 1270_1 and 1270_2 mounted on the printer 1200 (step S23 in FIG. 13).

In the event that the associated sheet is associated with the surface processors 1270_1 and 1270_2 mounted on the printer 1200, the CPU 1111 causes the image display unit 1202 to display on the display screen 1102*a* an image of a toner image wherein a surface processor associated with the designated sheet is used to apply the surface processing to the toner image to be formed on the sheet. In the event that the associated sheet is not associated with the surface processors 1270_1 and 1270_2 mounted on the printer 1200, the CPU 1111 causes the image display unit 1202 to display a message "no processing for surface processing is performed" on the display screen 1102*a* shown in FIG. 6.

Figure 14:
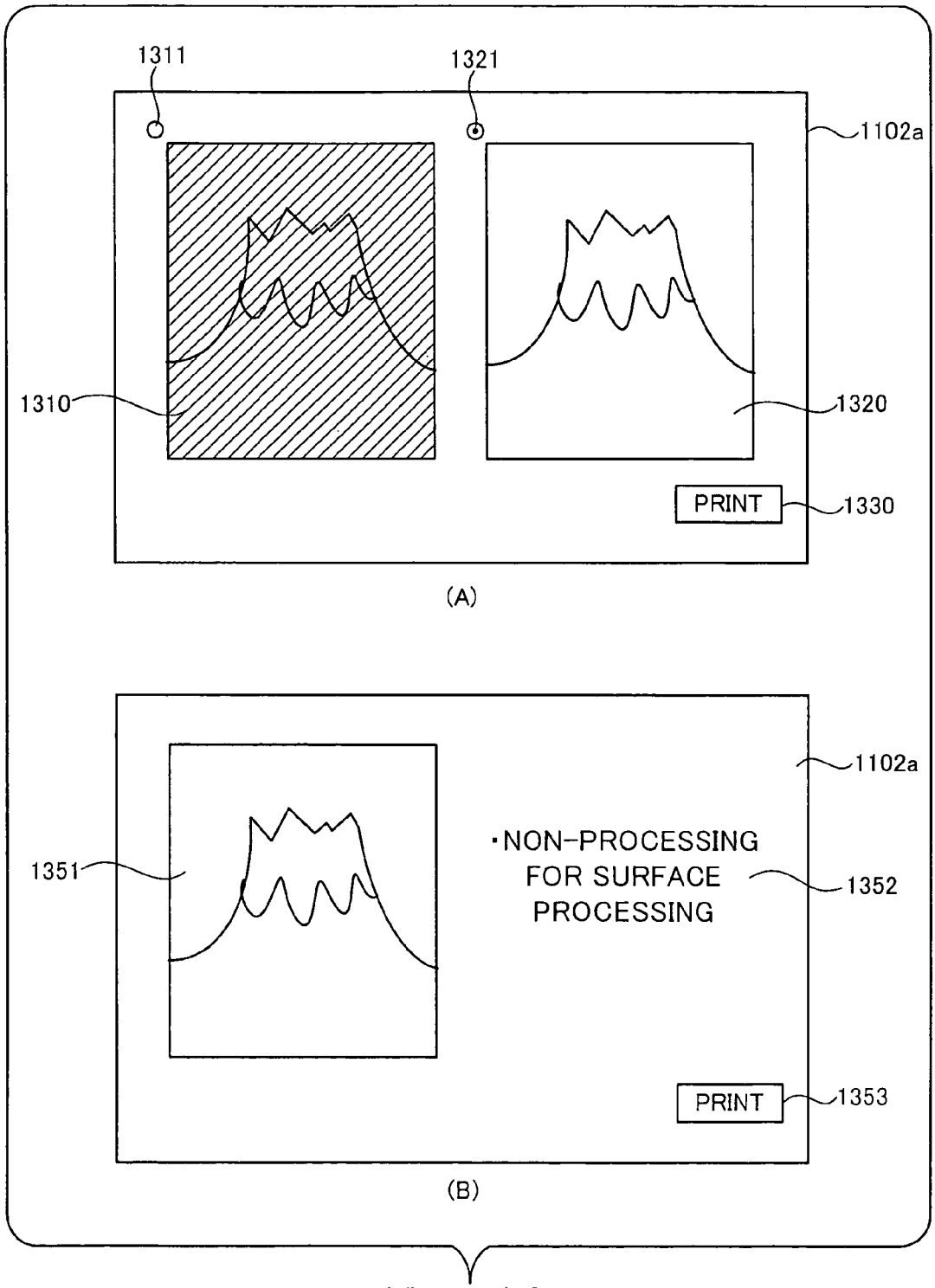
FIG. 14 is a view showing images to be displayed on a display screen.

FIG. 14 is a view showing images to be displayed on a display screen.

In the event that the sort of the designated sheet is associated with both the surface processors 1270_1 and 1270_2 mounted on the printer 1200, as shown in part (A) of FIG. 14, on the display screen 1102*a* shown in FIG. 6, there are displayed an image 1310 of the toner image subjected to the surface processing by the surface processor 1270_1, a selection button 1311 for selecting the image 1310, an image 1320 of the toner image subjected to the surface processing by the surface processor 1270_2, a selection button 1321 for selecting the image 1320, and a print output instruction button 1330. In the event that the sort of the designated sheet is associated with only one of the surface processors 1270_1 and 1270_2 mounted on the printer 1200, there is displayed only the associated image and the selection button. Thus, the operator confirms the images 1310 and 1320, and selects the image selection button associated with the image subjected to the desired surface processing, with the mouse and the like. In the event that none of the image 1310 and the image 1320 is selected, no surface processing is carried out.

In the event that the sort of the designated sheet is associated with none of the surface processors 1270_1 and 1270_2 mounted on the printer 1200, as shown in part (B) of FIG. 14, on the display screen 1102*a* shown in FIG. 6, there are displayed an image 1351 of the toner image to be fixed on the sheet, a message "no processing for surface processing is performed", and the print output instruction button 1330.

Thus, the operator confirms the display screen 1102*a* and selects the print output instruction button 1330 to instruct the print out (step S25 I FIG. 13).

When the operator instructs the print output, the CPU 1111 transmits image data representative of the image designated by the operator, and information representative of the sheet designated by the operator to the control section 1210 shown in FIG. 8, and in addition the surface processor ID of the surface processor associated with the selected image, or the instruction of "no processing for surface processing is performed".

In the event that the control section 1210 receives from the CPU 1111 the surface processor ID of the surface processor, the process goes from step S26 in FIG. 13 to step S27 in which the control section 1210 applies the primary fixing processing similar to the step S6 in FIG. 11 to the sheet selected by the operator.

The control section 1210 further controls the guide section 1250 in accordance with the surface processor ID of the surface processor informed by the CPU 1111 to guide the sheets subjected to the primary fixing processing to the conveyance paths L1_1 and L1_2 toward the surface processors 1270_1 and 1270 2 associated with the surface processor ID.

The surface processors 1270_1 and 1270_2 apply the surface processing to the sheets conveyed to the secondary fixing section 1270 (step S28 in FIG. 13).

In the event that the control section 1210 receives from the CPU 1111 the instruction of "no processing for surface processing is performed", the process goes from the step S26 in FIG. 13 to step S29.

In the step S29, the control section 1210 fixes the toner image on the sheet in accordance with the processing similar to the step S27 as mentioned above.

The control section 1210 controls the guide section 1250 to guide the sheet subjected to the primary fixing processing to the second conveyance path L2 for making for making a detour to avoid the secondary fixing section 1270. The sheet guided to the second conveyance path L2 is conveyed to the XY cutter 1280 without being subjected to processing for the surface processing.

In this manner, when an image of the toner image subjected to the surface processing is displayed prior to applying the processing for the surface processing to the sheet, it is possible for an operator to confirm the image of the toner image subjected to the processing for the surface processing beforehand.

Further, even if an operator does not know an association between a sort of the recording medium and a sort of the surface processor, provision of a plurality of surface processors makes it possible to automatically perform the surface processing suitable for the recording medium.

According to the present embodiment, as an example of the surface processor referred to in the present invention, there is raised an example in which a surface processor performs the surface processing for smoothing a surface of the toner image to provide a gloss, and the surface processor is mounted on the secondary fixing section. However, it is noted that the present invention is not restricted to this embodiment. For example, it is acceptable that the surface processor performs a mat processing in which a surface of the toner image is intentionally made opaque for the purpose of visual effects for a person looking the image. In this case, the secondary fixing belt of the surface processor has a rough surface so that a surface of the toner image is intentionally made opaque. Further, for example, it is acceptable that the surface processor is one in which a surface of a toner image is processed as a relief consisting of a predetermined roughness. In this case, the secondary fixing belt of the surface processor has a rough surface so that a surface of the toner image is processed as an intended relief.

Further, according to the present embodiment, there is raised an example of the secondary fixing section in which five sorts of surface processors, which are mutually different in a sort of the surface processing, can be mounted on an exchangeable basis. However, it is noted that the present invention is not restricted to this embodiment. Any one is acceptable, as the secondary fixing section, which pluralities of sorts of surface processors, which are mutually different in a size and a sort of the surface processing, can be mounted on an exchangeable basis.

Furthermore, according to the present embodiment, there is raised an example in which the storage section and the decision section referred to in the present invention are provided on the personal computer different from the printer. It is acceptable, however, that the structural elements of the printer of the present invention are provided on the same apparatus.

Still further, according to the present embodiment, there is raised an example in which an operator selects a sort of the sheet to decide the surface processor meet the sheet. However, it is noted that the present invention is not restricted to this embodiment. According to the printer of the present invention, it is acceptable that an operator selects a desired surface processor to decide the sheet associated with the surface processor so that an image is formed on the sheet.

With the above-mentioned description the explanation of the second and third embodiments of the printer of the present invention will be terminated. Next, there will be explained fourth embodiment of a printer of the present invention. The fourth embodiment of a printer of the present invention are concerned with the first and second embodiments of a printer of the present invention in many points similar to the first and second embodiments. With respect to the fourth embodiment, however, there will be completely explained the structural elements and the operation.

Figure 15:
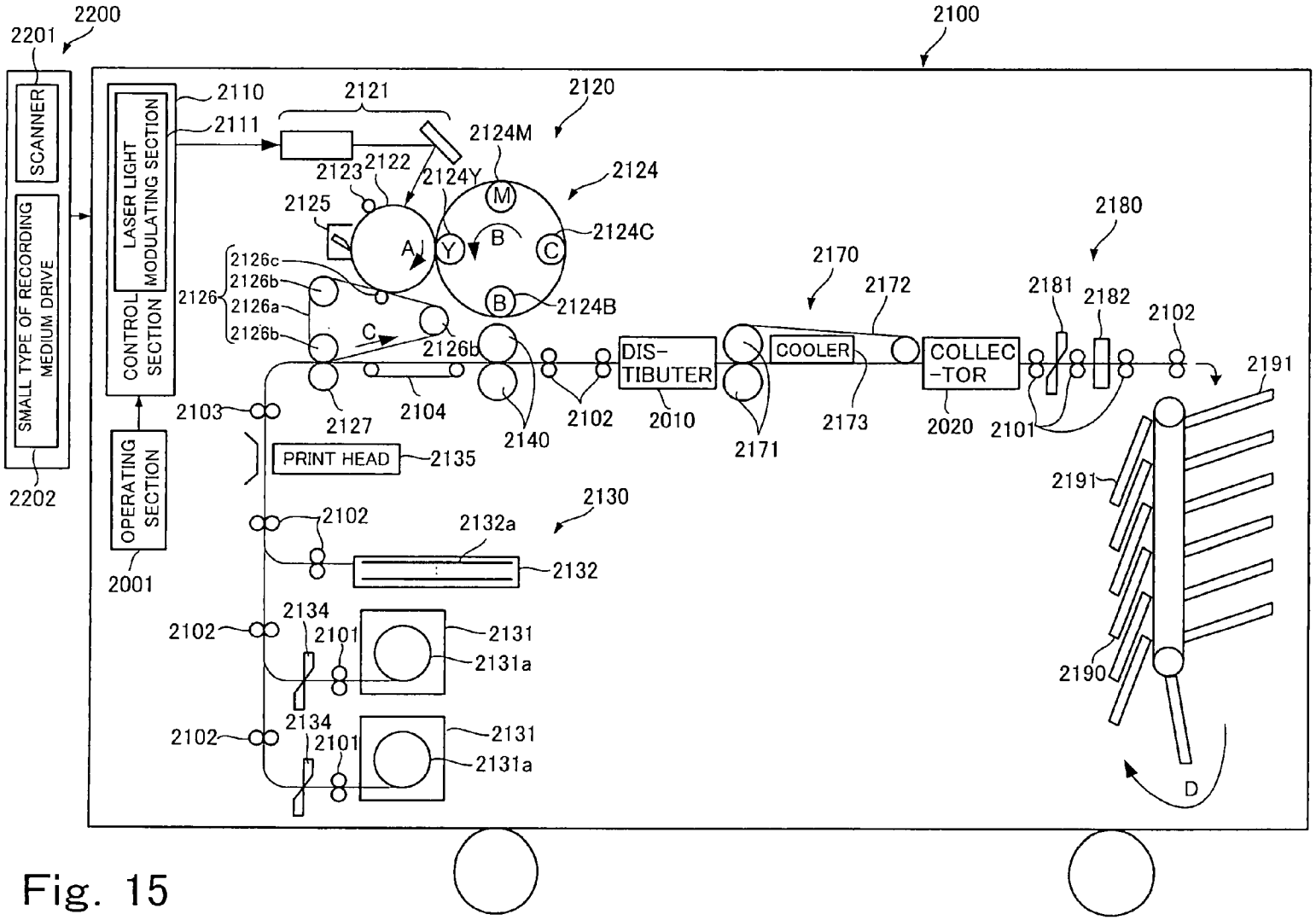
FIG. 15 is a view useful for understanding a fourth embodiment of a printer according to the present invention.

FIG. 15 is a view useful for understanding a fourth embodiment of a printer according to the present invention.

FIG. 15 shows a system of a mini-laboratory comprising a printer 2100 and an image input unit 2200.

The image input unit 2200 comprises a scanner 2201 for optically reading a photographic image recorded on a photographic film to generate photographic image data, and a small type of recording medium drive 2202 for reading from a small type of recording medium the photographic image data that is recorded on the small type of recording medium through photography by digital camera and the like. The image input unit 2200 generates output image data through application of correcting processing such as a color tone correction and a correction for white balance to the photographic image data obtained via the scanner 2201 or the small type of recording medium drive 2202. The output image data thus generated is transmitted to the printer 2100.

The printer 2100 shown in FIG. 15 is a printer adopting an electrophotographic system, in which there is formed a color image, which consists of a fixed toner image, on a recording sheet, in such a manner that the toner image of a plurality of colors of color toners is transferred and fixed onto the recording sheets to be conveyed. Applied to the printer 2100 is an example of an image forming method of the present invention, which will be described later, of forming a color image consisting of a fixed toner image on a recording sheet, in such a manner that the toner image of a plurality of colors of color toners is transferred and fixed onto the recording sheets to be conveyed.

The printer 2100 comprises a control section 2110 including a laser light modulation section 2111 for modulating a laser beam emitted from the laser in accordance with output image data outputted from the image input unit 2200, and CPU, ROM and the like, which are not illustrated. The control section 2110 carries out an image forming step, a primary transfer step, a distribution step, and a secondary fixing step, of performing an operation control for the structural elements of the printer 2100, which will be described later. The image forming step, the primary transfer step, the distribution step, and the secondary fixing step, which are carried out in the control section 2110, correspond to the image forming step, the primary transfer step, the distribution step, and the secondary fixing step in the image forming method of the present invention, respectively.

The printer 2100 is provided with an operating section 2001 for performing various setting up operated by an operator.

The printer 2100 has an image forming section 2120. The image forming section 2120 forms a toner image of four colors of color toner and transfers the toner-image onto a recording sheet in the image forming step to be executed in the control section 2110. The image forming section 2120 comprises an exposure section 2121, an image carrier roll 2122, a charging roll 2123, a development unit 2124, a cleaner 2125, an intermediate transfer section 2126, and a secondary transfer roll 2127. The image forming section 2120 corresponds to an example of the image forming section in the printer according to the present invention.

The image carrier roll 2122, which rotates in an arrow A direction, is charged in its surface by the charging roll 2123. The thus charged surface of the image carrier roll 2122 is scanning-exposed by the exposure section 2121 with laser beams modulated in accordance with output image data from the image input unit 2200. Thus, there is formed an electrostatic latent image consisting of a predetermined surface potential on the surface of the image carrier roll 2122.

The exposure section 2121 comprises a light source (not illustrated) such as a semiconductor laser, and an optical system for performing a scanning-exposure by leading laser beams emitted from the light source onto the image carrier roll 2122 in accordance with the output image data from the image input unit 2200, the optical system comprising a polygon mirror, a reflection mirror and various sorts of lenses. The exposure section 2121 serves to write the electrostatic latent image onto the image carrier roll 2122.

The developing unit 2124 comprises developing devices 2124Y, 2124M, 2124C and 2124B for each of colors of yellow (y), magenta (M), cyan (C), and black (B), which are disposed at intervals of 90°. Any of the developing devices 2124Y, 2124M, 2124C and 2124B adopts a so-called magnetic brush development scheme, and accommodates therein two-component developer including a toner and a carrier. The developing unit 1224 rotates in an arrow B direction at intervals of intervals of 90°, so that any one of the developing devices 2124Y, 2124M, 2124C and 2124B closely faces the image carrier roll 2122 keeping a predetermined minute distance. The developing device, which closely faces the image carrier roll 2122, causes a toner to adhere on an electrostatic basis to the electrostatic latent image formed on the surface of the image carrier roll 2122 in accordance with the magnetic brush effect, so that a toner image of a color associated with the developing device is formed on the surface of the image carrier roll 2122.

The intermediate transfer section 2126 is constructed in such a manner that an intermediate transfer belt 2126*a* is constructed movably in an arrow C direction by catenary rolls 2126*b*. A primary transfer roll 2126*c* is disposed at a primary transfer position in which the intermediate transfer belt 2126*a* is closely contact with the image carrier roll 2122. The primary transfer roll 2126*c* applies a transfer voltage to the intermediate transfer belt 2126*a*. The toner image, which is formed on the surface of the image carrier roll 2122 by the developing devices 2124Y, 2124M, 2124C and 2124B incorporated into the developing unit 2124, is transferred to the intermediate transfer belt 2126*a* by the transfer voltage at the primary position.

In the event that an image now to be formed is a color image, first, the exposure section 2121 forms an electrostatic latent image for yellow (Y) on the surface of the image carrier roll 2122. A toner is absorbed into the electrostatic latent image from the developing device 2124Y for yellow closely facing the image carrier roll 2122 by rolling of the developing unit 2124, so that a toner image of yellow is formed on the surface of the image carrier roll 2122. The toner image of yellow is transferred to the intermediate transfer belt 2126*a*. Thereafter, the exposure section 2121 forms an electrostatic latent image for magenta (M) on the surface of the image carrier roll 2122, which is removed in the residual toner on its surface by the cleaner 2125. At that time, a toner is absorbed into the electrostatic latent image from the developing device 2124M for magenta closely facing the image carrier roll 2122 by rolling of the developing unit 2124 by 90°, so that a toner image of magenta is formed on the surface of the image carrier roll 2122. The toner image of magenta is transferred to the intermediate transfer belt 2126*a* in such a manner that the toner image of magenta is superposed on the toner image of yellow, which is already transferred. Hereinafter, in a similar fashion, toner images of the remaining cyan (C) and black (B) are sequentially transferred onto the intermediate transfer belt 2126*a*. A control section 2110 controls the catenary rolls 2126*b* for moving the intermediate transfer belt 2126*a* so that the toner images for the respective colors, which are sequentially transferred, are exactly overlapped with one another.

The toner image transferred via the above-mentioned operation to the intermediate transfer belt 2126*a* is further transferred to a sheet-like shaped recording medium conveyed from a sheet supplying section 2130, which will be explained later, by the secondary transfer roll 2127 disposed over against one of the catenary rolls 2126*b* via the intermediate transfer belt 2126*a*. As a result, a toner image of color is formed on the surface of the recording medium.

Next, there will be explained the sheet supplying section 2130 for supplying the sheet-like shaped recording sheet to the image forming section 2120, which the printer 2100 shown in FIG. 15 is provided with.

The sheet supplying section 2130 is provided with roll paper storage sections 2131 each loaded with a roll paper 2131*a* as a recording sheet. While FIG. 15 shows two roll paper storage sections 2131, by way of example, the present invention is not restricted to this embodiment. It is acceptable that a printer of the-present invention is provided with one roll paper storage section, or three or more roll paper storage sections to be loaded with roll papers 2131*a*, which are different from one another in size in a width direction and a sort.

The roll papers 2131*a* are drawn out by positioning rolls 2101, which are provided in the vicinity of roll paper taking out slots of the roll paper storage sections 2131, respectively, and are conveyed to roll paper cutters 2134, which are disposed at the downstream side of the positioning rolls 2101 in the conveyance path for the sheets. After the roll paper 2131*a* is subjected to the positioning by the positioning roll 2101, the roll paper 2131*a* is cut by the roll paper cutter 2134 into a predetermined size. The positioning rolls 2101 are controlled by the control section 2110 so that the positioning rolls 2101 make a positioning of the roll papers 1231*a* in accordance with a size of a sheet to be cut.

The sheet-like shaped recording sheets, which are cut out from the roll paper storage sections 2131, are conveyed by a plurality of conveyance rolls 2102 disposed at several places on the conveyance path that is formed with the plurality of conveyance rolls.2102 in the printer 2100.

The sheet supplying section 2130 is also provided with a sheet cassette 2132 for storing sheet-like shaped recording sheets as a recording sheet. While FIG. 15 shows the use of a single sheet cassette 2132, by way of example, the present invention is not restricted to this embodiment. It is acceptable that a printer of the present invention is provided with a plurality of sheet cassettes 2132 for storing recording sheets, which are different from one another in size and sort.

The recording sheet 2132*a* is taken out by the conveyance roll 2102, which is provided in the vicinity of a sheet taking out slot of the sheet cassette 2132, and is conveyed to the downstream side in the conveyance path.

The conveyance paths from the roll paper cutters 2134 and the conveyance path from the sheet cassette 2132 are combined into a single conveyance path at the downstream side. On the single conveyance path, there is disposed a printing head 2135 for printing various sorts of print information on a back of the conveyed recording sheet. The print information printed by the printing head 2135 includes, for example, information such as various sorts of set up parameters in image forming set up by an operator, as well as a frame number indicative of correspondence of an image to be printed on the recording paper to an image on a film, and date of the photography of the image.

A resist roll 2103, which is disposed at the downstream side with respect to the printing head 2135, conveys the recording sheet subjected to printing onto the back by the printing head 2135 to the secondary transfer roll 2127 of the image forming section 2120, which is located at the further downstream side of the conveyance path, in accordance with timing (which will be described later). The secondary transfer roll 2127 transfers a color of toner image, which is already formed on the intermediate transfer belt 2126*a*, onto the recording sheet thus conveyed.

As mentioned above, in the event that the toner image of color is formed on the intermediate transfer belt 2126*a*, the intermediate transfer belt 2126*a* rotatably moves four times in an arrow C direction so that toner images of YMCB four colors are transferred onto the intermediate transfer belt 2126*a* one by one in color whenever the intermediate transfer belt 2126*a* rotates once. According to the present embodiment, in the event that the toner image of color is formed on the intermediate transfer belt 2126*a*, a conveyance of the recording sheet to the secondary transfer roll 2127 by the resist roll 2103 is carried out in such a manner that the recording sheet is conveyed to the secondary transfer roll 2127 in timing that the toner image of color formed on the intermediate transfer belt 2126*a* through transfer of toner images of all four colors first faces the secondary transfer roll 2127. The control section 2110 controls the resist roll 2103 so as to perform a conveyance of the sheet in the timing as mentioned above.

In the manner as mentioned above, the recording sheet, onto which the toner image is transferred, is conveyed via a conveyance belt 2104 disposed at the downstream side of the secondary transfer roll 2127 to a primary fixing section 2140 that is disposed at the further downstream side of the conveyance path. The primary fixing section 2140 fixes the toner image transferred to a recording sheet onto the recording sheet in accordance with a primary fixing step to be carried out in the control section 2110. Specifically, the primary fixing section 2140 applies heating and pressure processing to the recording sheet, onto which the toner image is transferred, so that the toner image is fixed on the sheet. An image, which is obtained through fixing of the toner by the primary fixing section 2140, has an image quality equivalent to that of an image obtained by a color copying machine and the like, while it falls short of high picture quality required for photographic image and the like. The primary fixing section 2140 corresponds to an example of the primary fixing section in a printer of the present invention.

The recording sheet, which is subjected to the processing by the primary fixing section 2140, is conveyed to a distribution section 2010 by the conveyance rolls 2102.

The distribution section 2010 distributes recording sheets carrying the toner image after being fixed in the primary fixing step in a width direction perpendicular to the conveyance direction in accordance with a distribution step to be carried out in the control section 2110. Specifically, the distribution section 2010 distributes in the width direction the recording sheets carrying the toner image after being fixed in the primary fixing section 2140. The distribution section 2010 is disposed between the primary fixing section 2140 and a secondary fixing section 2170, which will be described later. A structure of the distribution section 2010 will be described later.

The secondary fixing section 2170 fuses at least surface portion of a fixed toner image on the recording sheet distributed in the distribution step to regulate a surface of the fixed toner image in accordance with the secondary fixing step to be executed in the control section 2110. The secondary fixing section 2170 comprises a heating and pressure rolls 2171 for applying the heating and pressure processing to a plurality of recording sheets distributed in the width direction by the distribution section 2010, a secondary fixing belt 2172 having a smooth glossy surface, the secondary fixing belt 2172 circularly moving, and a cooler 2173 for cooling the plurality of recording sheets heated by the heating and pressure rolls 2171. The secondary fixing section 2170 corresponds to an example of the secondary fixing section referred to in the present invention.

In the secondary fixing section 2170, first, the heating and pressure rolls 2171 heat and fuse the toner image fixed on the sheet in the primary fixing section 2140, and press the surface of the fused toner image against the smooth glossy surface of the secondary fixing belt 2172. The recording sheet is conveyed to the downstream side in the state that the recording sheet is sticking to the glossy surface of the secondary fixing belt 2172. The recording sheet, which is sticking to the glossy surface, is cooled by the cooler 2173 disposed at the downstream of the heating and pressure rolls 2171. Thus, the toner image fused on the recording sheet is solidified. Thereafter, the recording sheet is conveyed to the further downstream side, and is separated from the glossy surface of the secondary fixing belt 2172 by rigidity of the recording sheet itself as the secondary fixing belt 2172 is flexible.

Thus, according to the printer 2100 of the present embodiment, the distribution section 2010 distributes the recording sheets conveyed from the primary fixing section 2140 in the width direction perpendicular to the conveyance direction, and conveys the recording sheets to the secondary fixing section 2170, so that the secondary fixing section 2170 simultaneously performs processing for regulating a surface of a plurality of recording sheets. Accordingly, it is possible to reduce the processing time for regulating a surface of the toner images to be carried out in the secondary fixing section 2170 and thereby efficiently forming an image of high picture quality.

The separated recording sheets are conveyed to a collecting section 2020. The collecting section 2020 collects the recording sheets carrying the fixed toner image regulated in surface in accordance with a collecting step-to be carried out in the control section 2110. Thus, it is possible to reduce a size of the conveyance path in the width direction at the downstream of the collecting section 2020, and also to reduce a time for collecting the recording sheets. An operation of the collecting section 2020 is opposite to the operation of the distribution section 2010. A structure of the collecting section 2020 is the same as the structure of the distribution section 2010, which will be described later. The collecting section 2020 corresponds to an example of the collecting section in a printer of the present invention. The collecting step to be executed in the control section 2110 corresponds to the collecting step in an image forming method of the present invention.

An XY cutter 2180 is disposed at the further downstream side of the collecting section 2020. The recording sheets collected by the collecting section 2020 are conveyed to the XY cutter 2180.

The XY cutter 2180 comprises a first cutter 2181 for cutting the recording sheet vertically with respect to the conveyance direction, and a second cutter 2182 for cutting the recording sheet along the conveyance direction. The first cutter 2181 and the second cutter 2182 are disposed in series on the conveyance path. Positioning rolls 2101 are disposed between the first cutter 2181 and the second cutter 2182, and at the downstream side of the second cutter 2182, respectively. Those positioning rolls 2101 perform the positioning of the sheet for the XY cutter 2180. The control section 2110 controls the positioning rolls 2101 to perform the positioning of the sheet.

The cutting of the sheet by the XY cutter 2180 is carried out by set up of an operator in compliance with the wishes of customers. For example, in the event that the recording sheet conveyed to the XY cutter 2180 is one cut out from roll papers 1231*a*, and a size of the recording sheet cut out from the roll papers 1231*a* is larger somewhat than the photographic size, the XY cutter 2180 carries out the cutting in accordance with the photographic size. Further, in the event that what a customer wishes is a photographic print having no frame, the XY cutter 2180 cuts the recording sheet to cut the frame encircled the photographic image. Furthermore, for example, in the event that the recording sheet conveyed to the XY cutter 2180 is of a size of photography derived from the sheet cassette 2132, the XY cutter 2180 carries out no cutting, and the recording sheet is conveyed to a sorter 2190, which will be described later. Still further, also in the event that photography is printed on a regular size of recording sheet such as a postcard, the recording sheet is conveyed directly to the sorter 2190, which will be described later.

The recording sheets, which are subjected to the processing such as the fixing and cutting as mentioned above, are conveyed and stacked to the sorter 2190 that disposed at the final downstream end of the conveyance path. A stack of the recording sheets to the sorter 2190 is carried out in the manner as set forth below.

For example, when a block of recording sheets obtained from a film is stored in a storage section 2191 of the sorter 2190, which is located at a predetermined storage position, the sorter 2190 rotates in an arrow D direction, so that an empty storage section 2191 moves to the storage position. And a block of recording sheets is stored in the empty storage section 2191. Thus, all blocks of sheets are stored in the empty storage sections 2191 with sorting for each block. The control section 2110 controls the operation of the sorter 2190.

Figure 16:
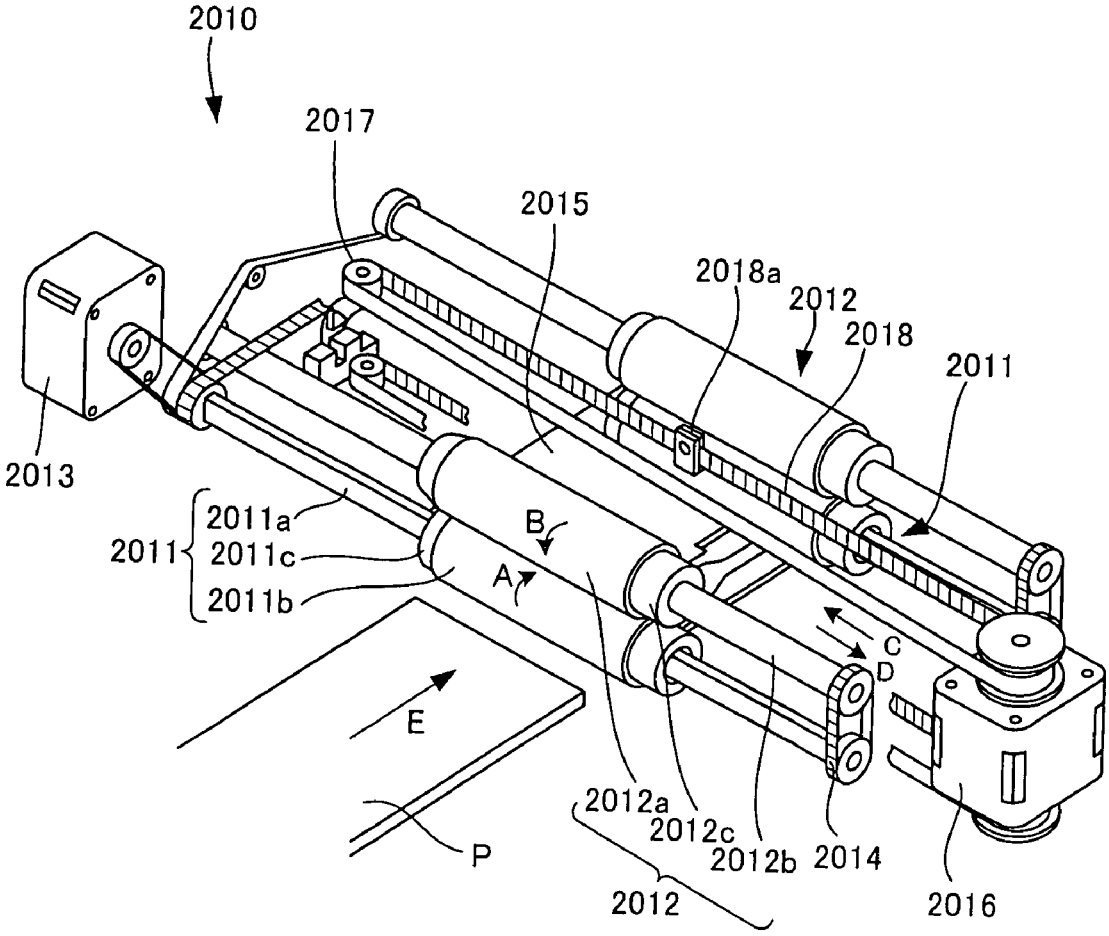
FIG. 16 is a perspective view of a distribution section shown in FIG. 15.

FIG. 16 is a perspective view of a distribution section shown in FIG. 15.

The distribution section 2010 shown in FIG. 16 comprises two pair of driving rolls 2011 and sub-driving rolls 2012. The driving rolls 2011 each comprise a rotary shaft 2011*a* that rotates by a driving force of a motor 2013, a roll portion 2011*b* that rotates in an arrow A direction in accordance with the rotation of the rotary shaft 2011*a*, and a cylindrical member 2011*c*. The sub-driving rolls 2012 each comprise a roll portion 2012*a* that rotates in an arrow B direction in accordance with the rotation of the roll portion 2011*b* in the arrow A direction, a shaft member 2012*b* that applies a predetermined pressure to the driving rolls 2011, in which an edge portion of the shaft member 2012*b* is held through a belt 2014 on a member supporting the rotary shaft 2011*a*, and a cylindrical member 2012*c*. The cylindrical member 2011*c* constituting the driving roll 2011 and the cylindrical member 2012*c* constituting sub-driving roll 2012, which are illustrated before hands in FIG. 16, are coupled through coupling members 2015 with the cylindrical member 2011*c* constituting the driving roll 2011 and the cylindrical member 2012*c* constituting sub-driving roll 2012, which are illustrated at the back in FIG. 16, respectively.

The distribution section 2010 further comprises a motor 2016 that reversibly rotates, and a driving belt 2018 constructed between a shaft portion of the motor 2016 and a construction roll 2017. The driving belt 2018 moves in an arrow C direction when the motor 2016 forward rotates, and the driving belt 2018 moves in an arrow D direction when the motor 2016 reversely rotates. A fixing member 2018*a* is mounted on the driving belt 2018. The fixing member 2018*a* is fixed on the coupling member 2015. Accordingly, when the driving belt 2018 moves in the arrow C direction, the two pair of driving rolls 2011 and sub-driving rolls 2012 simultaneously move in the arrow C direction. When the driving belt 2018 moves in the arrow D direction, the two pair of driving rolls 2011 and sub-driving rolls 2012 simultaneously move in the arrow D direction. At the initial state or the set state, the two pair of driving rolls 2011 and sub-driving rolls 2012 are located at the center shown in FIG. 16.

Here, a first recording paper P, on which a toner image is fixed in the primary fixing section 2140, is conveyed to the distribution section 2010 from an arrow E direction. Then, the top of the recording paper P is conveyed while being supported in cooperation with the pair of driving roll 2011 and sub-driving roll 2012 appearing before hands. The top of the recording paper P thus conveyed reaches the pair of driving roll 2011 and sub-driving roll 2012 appearing at the back, and is conveyed while being supported in cooperation with the pair of driving roll 2011 and sub-driving roll 2012 appearing at the back. In this manner, when the recording paper P is conveyed while being supported in cooperation with the two pairs appearing before hands and at the back, the motor 2016 forward rotates. Then, the driving belt 2018 moves in the arrow C direction, so that the two pair of driving rolls 2011 and sub-driving rolls 2012 move in the arrow C direction. In this manner, the first recording paper P moves to the left side of the back in FIG. 16, and is conveyed on the conveyance path in the distribution section 2010.

Next, a second recording paper P is conveyed. In a similar fashion to that of the first recording paper P, when the recording paper P is conveyed while being supported in cooperation with the two pairs appearing before hands and at the back, the motor 2016 reversely rotates. Then, the driving belt 2018 moves in the arrow D direction, so that the two pair of driving rolls 2011 and sub-driving rolls 2012 move in the arrow D direction. In this manner, the second recording paper P moves to the right side of the back in FIG. 16, and is conveyed on the conveyance path in the distribution section 2010.

According to the printer 2100 of the present embodiment shown in FIG. 15, it is concerned with a printer for forming a color toner image on a recording paper of a size from an L-size (89 mm×127 mm) (referred to as a small size) to A-size (referred to as a large size), which are general as the photographic size. For this reason, a size of the conveyance path in the width direction in the printer and sizes of the primary fixing section 2140 and the secondary fixing section 2170 in the longitudinal direction are sizes corresponding to the sizes of a large size of recording paper in a width direction.

Figure 17:
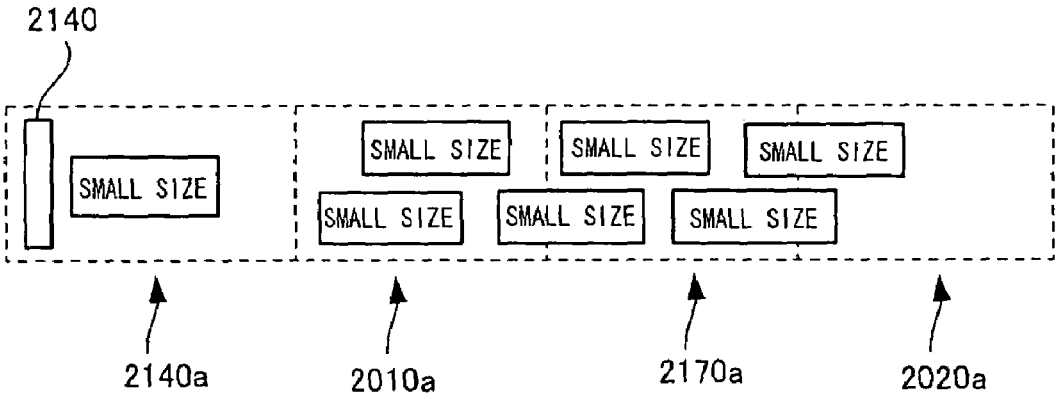
FIG. 17 is an explanatory view useful for understanding a state that the distribution section distributes small size of recording sheets and conveys the same on a conveyance path in the printer shown in FIG. 15.

FIG. 17 is an explanatory view useful for understanding a state that the distribution section distributes small size of recording sheets and conveys the same on a-conveyance path in the printer shown in FIG. 15.

A size of a small size of recording sheet in the width direction is half or less than a size of the conveyance path in the width direction and sizes of the primary fixing section 2140 and the secondary fixing section 2170 in the longitudinal direction. For this reason, as shown in FIG. 17, small sizes of recording sheets, in which a toner image is fixed in the primary fixing section 2140, are sequentially conveyed on a conveyance path 2140*a* in the primary fixing section 2140, separated by the distribution section 2010 into two rows, and conveyed on a conveyance path 2010*a* in the distribution section 2010. Next, the small sizes of recording sheets are regulated in a surface in the secondary fixing section 2170 and then conveyed on a conveyance path 2170*a* in the secondary fixing section 2170. Further, the small sizes of recording sheets are collected in the collecting section 2020, so that the small sizes of recording sheets are arranged into a line and are conveyed on a conveyance path 2020*a* in the collecting section 2020. In this manner, it is possible to enhance the working efficiency of the printer 2100.

Figure 18:
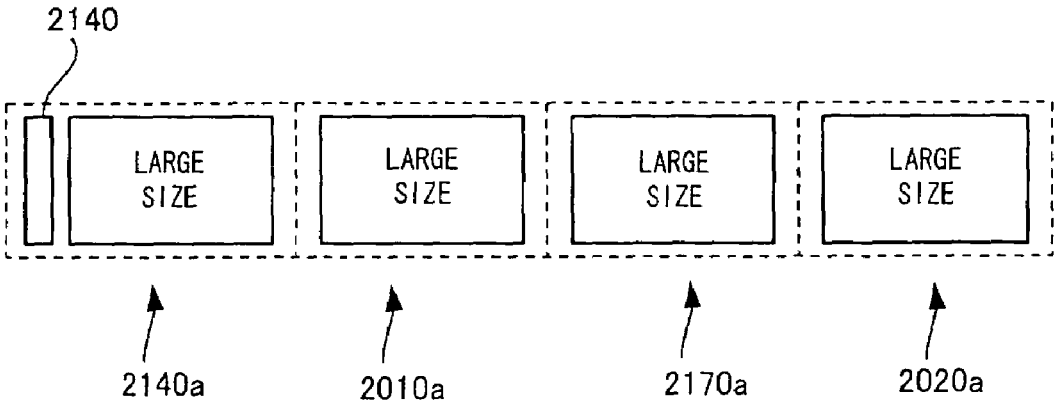
FIG. 18 is an explanatory view useful for understanding a state that large size of recording sheets are conveyed on a conveyance path in the printer shown in FIG. 15.

FIG. 18 is an explanatory view useful for understanding a state that large size of recording sheets are conveyed on a conveyance path in the printer shown in FIG. 15.

A size of a large size of recording sheet in the width direction is half or more than a size of the conveyance path in the width direction and sizes of the primary fixing section 2140 and the secondary fixing section 2170 in the longitudinal direction. For this reason, large sizes of recording sheets are conveyed without being distributed in the distribution section 2010. Specifically, as shown in FIG. 18, large sizes of recording sheets, in which a toner image is fixed in the primary fixing section 2140, are conveyed on the conveyance path 2140*a* in the primary fixing section 2140, and conveyed on the conveyance path 2010*a* without being distributed in the distribution section 2010. Next, the large sizes of recording sheets are regulated in a surface in the secondary fixing section 2170 and then conveyed on a conveyance path 2170*a* in the secondary fixing section 2170. Further, the large sizes of recording sheets are conveyed on the conveyance path 2020*a* in the collecting section 2020, without being collected in the collecting section 2020.

Figure 19:
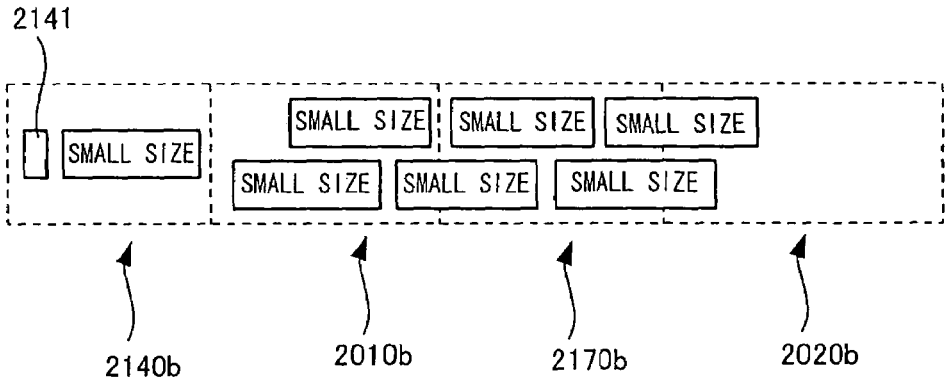
FIG. 19 is an explanatory view useful for understanding a state that small size of recording sheets are conveyed on a conveyance path in a printer having a small size of recording sheet-dedicated primary fixing section.

FIG. 19 is an explanatory view useful for understanding a state that small size of recording sheets are conveyed on a conveyance path in a printer having a small size of recording sheet-dedicated primary fixing section.

A primary fixing section 2141 shown in FIG. 19 fixes a toner image transferred on a small size of recording sheet onto the recording sheet. A size of the primary fixing section 2141 in the longitudinal direction corresponds to a size of the small size of recording sheet in the width direction. The primary fixing section 2141 fixes the toner image transferred on the small size of recording sheet onto the recording sheet. Next, the small size of recording sheets are sequentially conveyed on a conveyance path 2140*b* in the primary fixing section 2141, separated by the distribution section 2010 into two rows, and conveyed on a conveyance path 2010*b* in the distribution section 2010. Next, the small sizes of recording sheets are regulated in a surface in the secondary fixing section 2170 and then conveyed on a conveyance path 2170*b* in the secondary fixing section 2170. Further, the small sizes of recording sheets are collected in the collecting section 2020, so that the small sizes of recording sheets are arranged into a line and are conveyed on a conveyance path 2020*b* in the collecting section 2020. In this manner, it is possible to contribute to reducing power consumption of the primary fixing section 2141.

Figure 20:
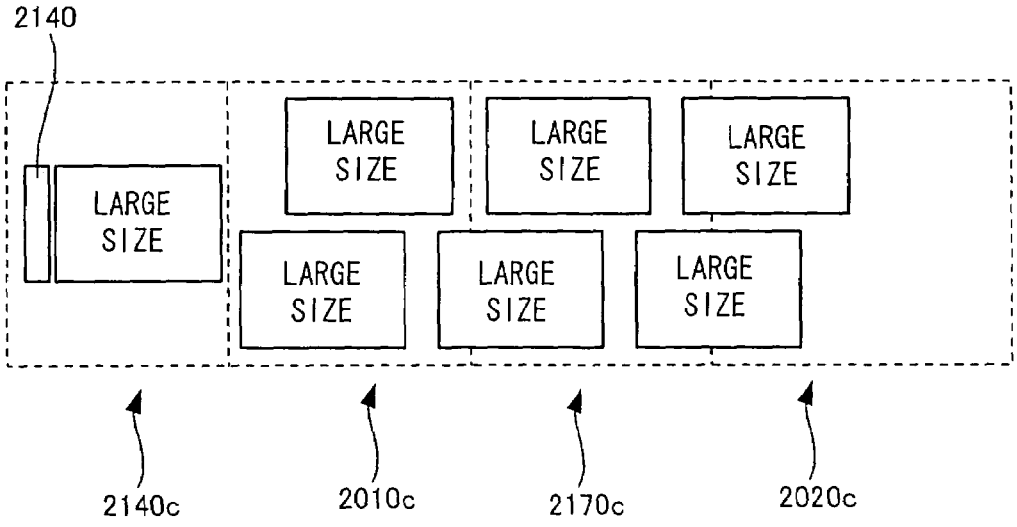
FIG. 20 is an explanatory view useful for understanding a state that large size of recording sheets are conveyed on a conveyance path in a printer which is capable of distributing large size of recording sheets.

FIG. 20 is an explanatory view useful for understanding a state that large size of recording sheets are conveyed on a conveyance path in a printer which is capable of distributing large size of recording sheets.

A size of the conveyance path in the width direction and a size of the secondary fixing section 2170 in the longitudinal direction exceed twice size of a large size of recording sheet in the width direction. This feature makes it possible to distribute large size of recording sheets too, and thereby enhancing the working efficiency of the printer. Specifically, as shown in FIG. 20, large sizes of recording sheets, in which a toner image is fixed in the primary fixing section 2140, are sequentially conveyed on the conveyance path 2140*c* in the primary fixing section 2140, and conveyed on the conveyance path 2010*c* with being distributed in the distribution section 2010 into two rows. Next, the large sizes of recording sheets are regulated in a surface in the secondary fixing section 2170 and then conveyed on a conveyance path 2170*c* in the secondary fixing section 2170. Further, the large sizes of recording sheets are collected in the collecting section 2020, so that the large sizes of recording sheets are arranged into a line and are conveyed one by one on a conveyance path 2020*c* in the collecting section 2020.

According to the printer 2100 shown in FIG. 15, there is explained an example in the distribution section 2010 is disposed separately from the primary fixing section 2140. However, it is acceptable that the primary fixing section distributes recording sheets in the width direction while fixing the toner image transferred onto the recording sheet. In this case, the distribution step is replaced by a step that recording sheets are distributed in the width direction while fixing the toner image transferred onto the recording sheet onto the recording sheet, instead of execution of the distribution step as a step independent of the step primary fixing step. Further, in this case, providing the driving roll 2011 shown in FIG. 16 as the heating roll and providing the sub-driving roll 2012 as the pressure roll make it possible to implement a primary fixing section serving as the distribution section, too.

Figure 21:
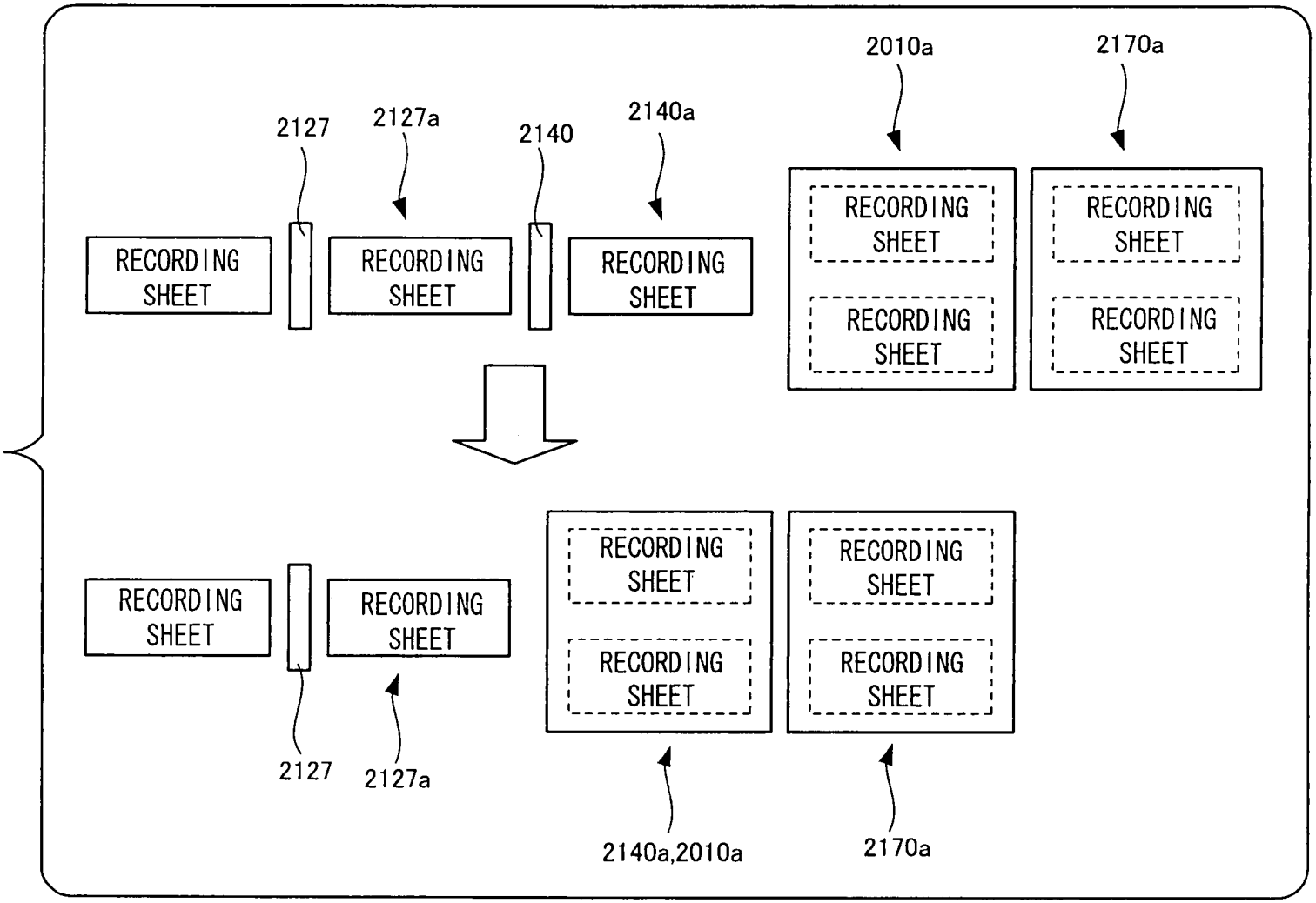
FIG. 21 is an explanatory view useful for understanding a comparison between a case where the distribution section is disposed separately from the primary fixing section and a case where the distribution section distribute recording sheets in a width-direction while the primary fixing section is fixing a toner image, when the recording sheets are conveyed on the conveyance path.

FIG. 21 is an explanatory view useful for understanding a comparison between a case where the distribution section is disposed separately from the primary fixing section and a case where the distribution section distribute recording sheets in a width-direction while the primary fixing section is fixing a toner image, when the recording sheets are conveyed on the conveyance path.

In the upper portion of FIG. 21, there is shown a state that recording sheets are conveyed on a conveyance path in the printer 2100 shown in FIG. 15, that is, the printer 2100 wherein the distribution section 2010 is disposed separately from the primary fixing section 2140.

As mentioned above, according to the printer 2100 shown in FIG. 15, the secondary transfer roll 2127 transfers the toner image transferred to the intermediate transfer belt 2126*a* onto a recording sheet, and transmits the recording sheet on a conveyance path 2127*a* in the secondary transfer roll 2127. Next, the recording sheets, on which a toner image is fixed in the primary fixing section 2140, are sequentially conveyed on the conveyance path 2140*a*. The recording sheets are separated by the distribution section 2010 into two rows, and conveyed on a conveyance path 2010*a* in the distribution section 2010. Next, the recording sheets are regulated in a surface in the secondary fixing section 2170 and then conveyed on a conveyance path 2170*a* in the secondary fixing section 2170.

On the other hands, in the lower portion of FIG. 21, there is shown a state that recording sheets are conveyed on a conveyance path in the printer wherein the primary fixing section distributes the recording sheets in the width direction while fixing the toner image.

According to the printer as mentioned above, the secondary transfer roll 2127 transfers the toner image transferred to the intermediate transfer belt 2126*a* onto a recording sheet, and transmits the recording sheet on a conveyance path 2127*a* in the secondary transfer roll 2127. Next, the recording sheets, on which a toner image is fixed in the primary fixing section 2140, are sequentially conveyed on the conveyance path 2140*a*. The recording sheets are separated by the distribution section 2010 into two rows, and conveyed on a conveyance path 2010*a* in the distribution section 2010. Next, the recording sheets are regulated in a surface in the secondary fixing section 2170 and then conveyed on a conveyance path 2170*a* in the secondary fixing section 2170. This feature makes it possible to contribute to a miniaturization of the apparatus.

According to the printer 2100 of the present embodiment, as an example of the secondary fixing section referred to in the present invention, there is raised an example in which the secondary fixing section performs the surface processing for smoothing a surface of the toner image of the recording paper to provide a gloss. However, it is noted that the present invention is not restricted to this embodiment. For example, it is acceptable that the secondary fixing section performs a mat processing in which a surface of the toner image is intentionally made opaque for the purpose of visual effects for a person looking the image. In this case, the secondary fixing belt of the secondary fixing section has a rough surface so that a surface of the toner image is intentionally made opaque. Further, for example, it is acceptable that the secondary fixing section is one in which a surface of a toner image is processed as a relief consisting of a predetermined roughness. In this case, the secondary fixing belt of the secondary fixing section has a rough surface so that a surface of the toner image is processed as an intended relief.

Figure 22:
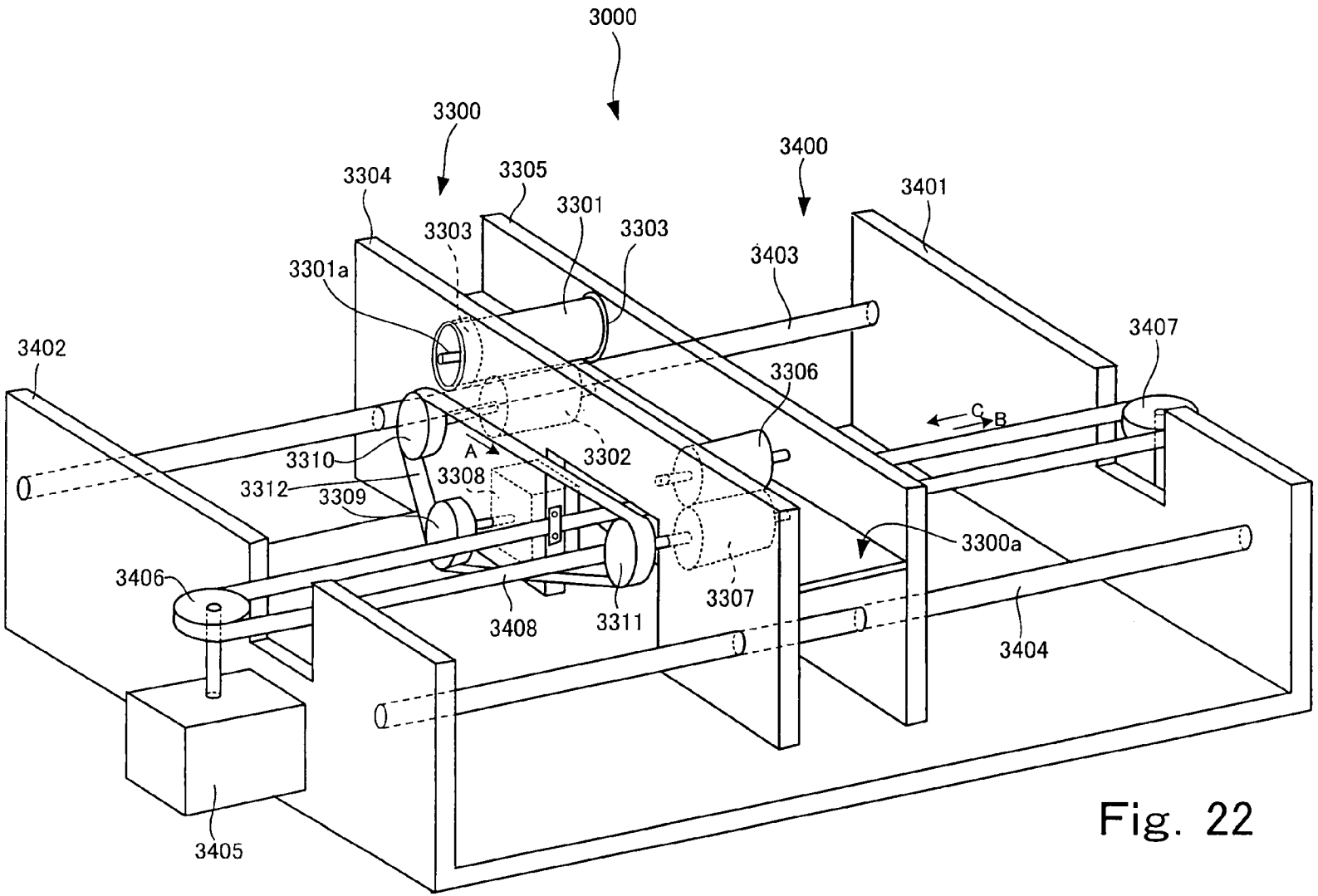
FIG. 22 is a perspective view of a fixing section sliding mechanism comprising a primary fixing section and a distribution section which are different from those shown in FIG. 15.

FIG. 22 is a perspective view of a fixing section sliding mechanism comprising a primary fixing section and a distribution section which are different from those shown in FIG. 15.

A fixing section sliding mechanism 3000 distributes recording sheets in the width direction while a toner image transferred to a recording sheet is fixed on the recording sheet. The fixing section sliding mechanism 3000 comprises a primary fixing section (referred to as a fixing unit) 3300 and a distribution section (referred to as a distributing unit) 3400.

The fixing unit 3300 comprises a heat roll 3301 and a pressure roll 3302. The heat roll 3301 has a heater 3301*a* that is rotatably mounted via bearings 3303 on plate members 3304 and 3305. The fixing unit 3300 further comprises a sub-driving roll 3306 and a feed roll 3307. The fixing unit 3300 furthermore comprises a driving motor 3308 for a conveyance of recording sheets. Construction rolls 3309, 3310 and 3311 are mounted on the driving motor 3308, the pressure roll 3302 and the feed roll 3307, respectively. A timing belt 3312 is constructed over the construction rolls 3309, 3310 and 3311. The fixing unit 3300 still further comprises a conveyance path 3300*a* for conveying recording sheets from the upper stream side (the back of FIG. 22) of the heat roll 3301 and the pressure roll 3302 to the downstream side (before hand of FIG. 22) of the sub-driving roll 3306 and the feed roll 3307. The conveyance path 3300*a* is of a size corresponding to the size of a small size of recording sheet in the width direction. According to the fixing unit 3300, as will be described later, when the driving motor 3308 rotates, the timing belt 3312 moves in an arrow A direction via the construction rolls 3309. Then the pressure roll 3302 and the feed roll 3307 rotate via the construction rolls 3310 and 3311, so that the heat roll 3301 and the sub-driving roll 3306 rotates in accordance with the rotation of the pressure roll 3302 and the feed roll 3307.

On the other hand, the distributing unit 3400 comprises plate members 3401 and 3402 disposed in such a manner that the fixing unit 3300 is sandwiched between the plate members 3401 and 3402, and slide shafts 3403 and 3404 on which the plate members 3401 and 3402 are fixed, respectively, wherein the fixing unit 3300 is slidably moved. Sizes of the plate members 3401 and 3402 correspond to a size of a large size of recording sheet in the width direction.

The distributing unit 3400 comprises a driving motor 3405 that reversibly rotates, a construction roll 3406 mounted on the driving motor 3405, a construction roll 3407 disposed on a side of the plate member 3401, and a timing belt 3408 constructed between the construction roll 3406 and the construction roll 3407. The timing belt 3408 is fixed on the driving motor 3308 provided on the fixing unit 3300. The timing belt 3408 moves in an arrow B direction, when the driving motor 3405 forward rotates, so that the fixing unit 3300 slides to the right side in FIG. 22. On the other hand, when the driving motor 3405 backward rotates, the timing belt 3408 moves in an arrow C direction, so that the fixing unit 3300 slides to the left side in FIG. 22.

Figure 23:
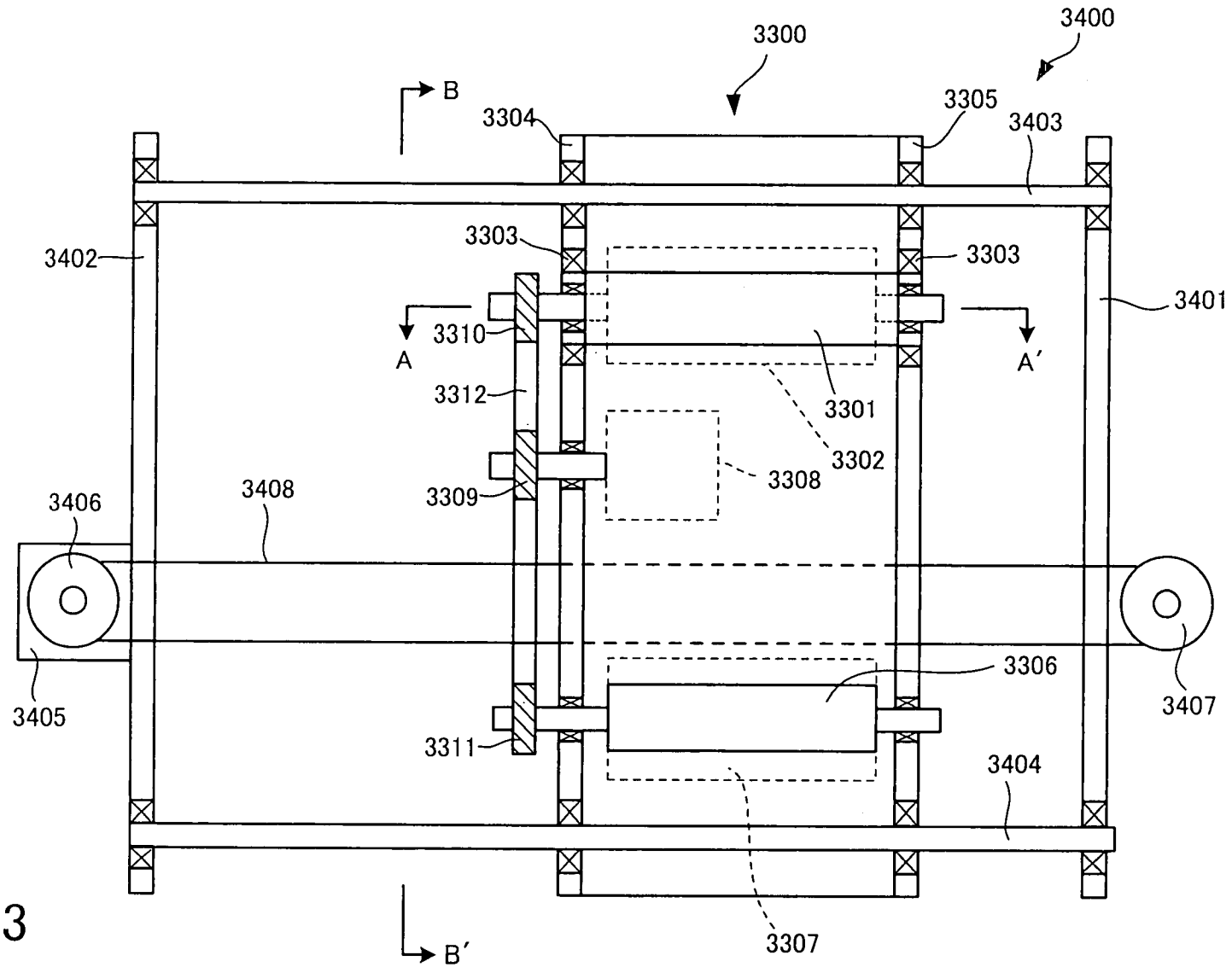
FIG. 23 is a top view of the fixing section sliding mechanism shown in FIG. 22.

FIG. 23 is a top view of the fixing section sliding mechanism shown in FIG. 22.

FIG. 23 shows the heat roll 3301 and the pressure roll 3302 disposed under the heat roll 3301. A size of the heat roll 3301 in the longitudinal direction is longer than a size of the pressure roll 3302 in the longitudinal direction. And the diameter of the heat roll 3301 is smaller than the diameter of the pressure roll 3302.

FIG. 23 also shows the sub-driving roll 3306 and the feed roll 3307 disposed under the sub-driving roll 3306. A size of the sub-driving roll 3306 in the longitudinal direction is equal to a size of the feed roll 3307 in the longitudinal direction. And the diameter of the sub-driving roll 3306 is smaller than the diameter of the feed roll 3307.

Figure 24:
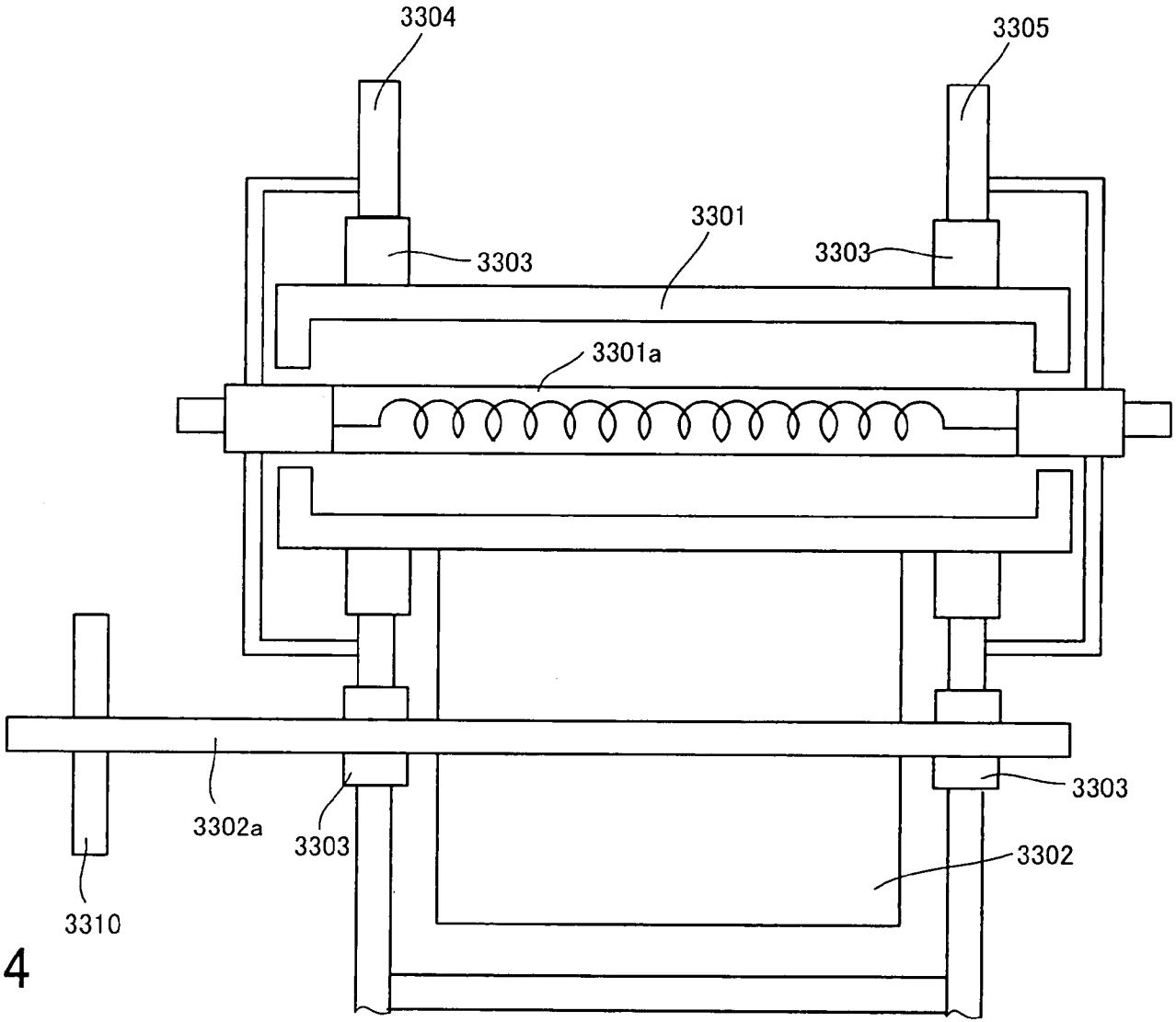
FIG. 24 is a sectional view of the fixing section sliding mechanism shown in FIG. 23 taken along the arrow A–A'.

FIG. 24 is a sectional view of the fixing section sliding mechanism shown in FIG. 23 taken along the arrow A–A'.

As shown in FIG. 24, the heat roll 3301 is rotatably mounted via the bearings 3303 on plate members 3304 and 3305. The heat roll 3301 has a heater 3301*a*. The pressure roll 3302 is disposed under the heat roll 3301. The pressure roll 3302 has a rotary shaft 3302*a*. The rotary shaft 3302*a* is rotatably mounted via the bearings 3303 on plate members 3304 and 3305.

Figure 25:
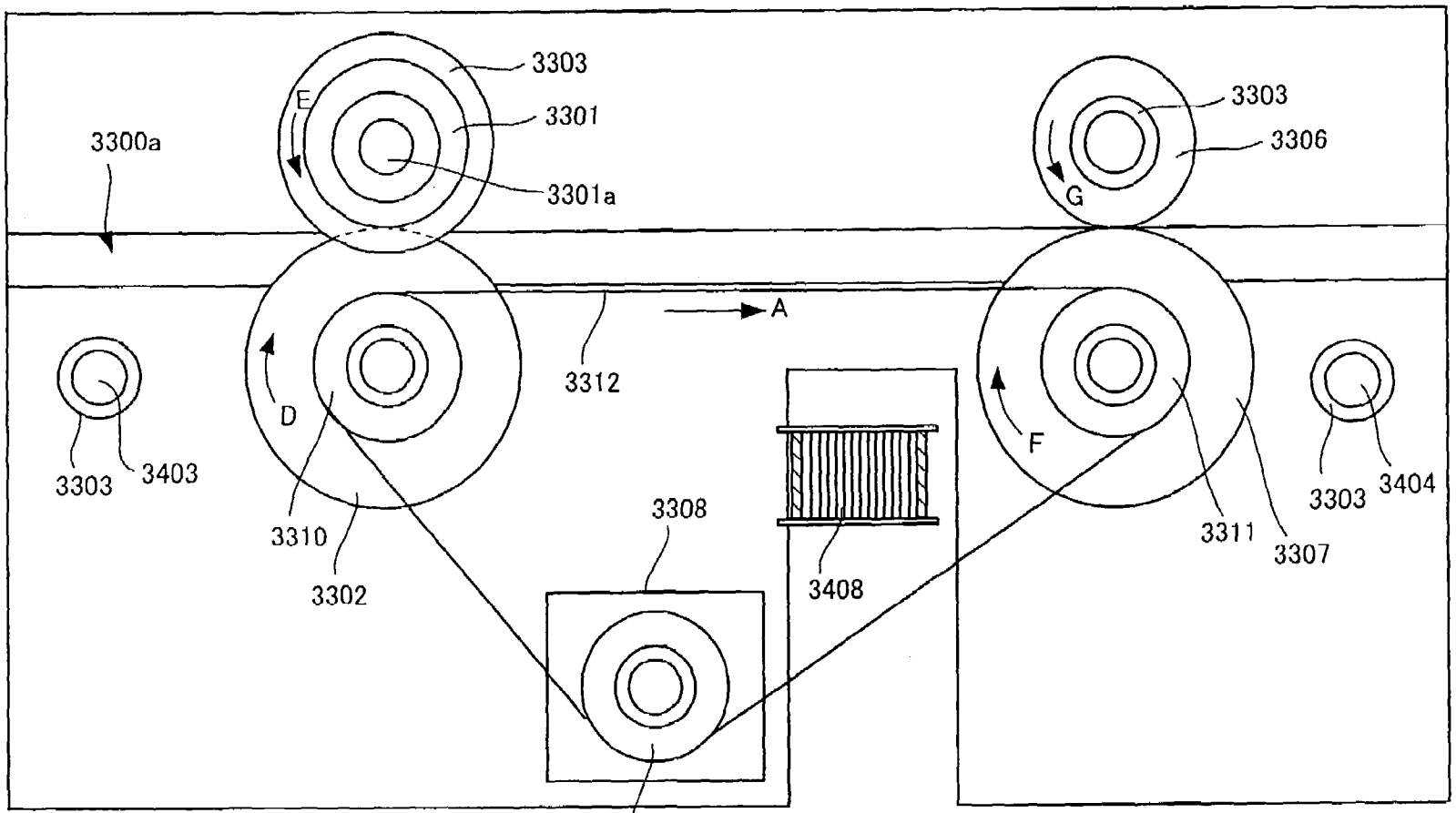
FIG. 25 is a sectional view of the fixing section sliding mechanism shown in FIG. 23 taken along the arrow B–B'.

FIG. 25 is a sectional view of the fixing section sliding mechanism shown in FIG. 23 taken along the arrow B–B'.

FIG. 25 shows the heat roll 3301 having the heater 3301*a*, which is held by the bearings 3303. FIG. 25 further shows the pressure roll 3302 that presses and drives the heat roll 3301. FIG. 25 furthermore shows the sub-driving roll 3306 held by the bearings 3303 and the feed roll 3307 that presses and drives the sub-driving roll 3306.

Here, a first recording sheet, on which a toner image is fixed, is conveyed from the left side in FIG. 25 to the conveyance path 3300*a*. And the driving motor 3308 rotates. Then, the timing belt 3312 moves via the construction roll 3309 in the arrow A direction, and the pressure roll 3302 rotates via the construction roll 3310 in the arrow D direction, so that the heat roll 3301 rotates in the arrow E direction. The feed roll 3307 rotates via the construction roll 3311 in the arrow F direction, so that the sub-driving roll 3306 rotates in the arrow G direction.

The top of the recording sheet is conveyed while being supported in cooperation with the heat roll 3301 and the pressure roll 3302, so that a toner image transferred to the recording sheet is heated and pressed so as to be fixed on the recording sheet. Further, the recording sheet is conveyed to the right side in FIG. 25, while being supported in cooperation with the sub-driving roll 3306 and the feed roll 3307. In this condition, the driving motor 3405 forward rotates. Then, the driving belt 3408 moves in the arrow B direction, so that the fixing unit 3300 moves to the right in FIG. 22 in its entirety. In this manner, the first recording sheet is conveyed to a portion of the right side in FIG. 22 (a portion having a size corresponding to the size of a small size of recording sheet).

Next, a second recording sheet is conveyed. In a similar fashion to that of the first recording sheet, when the recording sheet on which a toner image is fixed, is conveyed while being supported in cooperation with the sub-driving roll 3306 and the feed roll 3307, the driving motor 3405 reversely rotates. Then, the driving belt 3408 moves in the arrow C direction, so that the fixing unit 3300 moves to the left in FIG. 22 in its entirety. In this manner, the second recording sheet is conveyed to a portion of the left side in FIG. 22 (a portion having a size corresponding to the size of a small size of recording sheet). A secondary fixing section (not illustrated) simultaneously performs processing for regulating surfaces of the two recording sheet. In this manner, it is possible to reduce a processing time for regulating surfaces of the toner image to be carried out in the secondary fixing section, through distribution of the recording sheets in the width direction while the toner image transferred to the recording sheet is being fixed.

As mentioned above, according to the present invention, it is possible to provide a printer and an image forming method capable of being applied to a mini-laboratory, which is concerned with an electrophotographic system and is high in working efficiency.

While the present invention has been described with reference to the particular illustrative embodiments, it is not to be restricted by those embodiments but only by the appended claims. It is to be appreciated that those skilled in the art can change or modify the embodiments without departing from the scope and sprit of the present invention.

What is claimed is:

1. A printer comprising:

an image forming section that transfers a toner image onto a sheet-like shaped recording medium conveyed on a predetermined conveyance path, in which an electrostatic latent image is formed on a surface of an image carrier, and the toner image is formed on the surface of the image carrier by means of causing the electrostatic latent image to absorb toner;

a primary fixing section disposed at a downstream side of the image forming section in the conveyance path, the primary fixing section fixing on the recording medium the toner image transferred to the recording medium by the image forming section;

a storage section disposed at a downstream side of the primary fixing section in the conveyance path, the storage section storing the recording medium on which the toner image is fixed by the primary fixing section; and a secondary fixing section disposed at a downstream side of the storage section in the conveyance path, the secondary fixing section performing a surface processing for the toner image fixed by the primary fixing section.

2. A printer according to claim 1, wherein the printer further comprises a guide section disposed between the primary fixing section and the storage section in the conveyance path, the guide section selectively distributing the recording medium on which the toner image is fixed by the primary fixing section to a first conveyance path toward the storage section and a second conveyance path for making a detour to avoid the storage section and the secondary fixing section.

3. A printer comprising:

a medium supplying section that supplies to a predetermined conveyance path a recording medium selected from among a plurality of sorts of sheet-like shaped recording mediums;

an image forming section that transfers a toner image onto the recording medium supplied from the medium supplying section and conveyed on the predetermined conveyance path, in which an electrostatic latent image is formed on a surface of an image carrier, and the toner image is formed on the surface of the image carrier by means of causing the electrostatic latent image to absorb toner;

a primary fixing section disposed at a downstream side of the image forming section in the conveyance path, the primary fixing section fixing on the recording medium the toner image transferred to the recording medium by the image forming section;

a secondary fixing section disposed at a downstream side of the primary fixing section in the conveyance path, the secondary fixing section performing a surface processing for the toner image fixed by the primary fixing section, and having at least one sort of surface processor selected from a plurality of sorts of surface processors, wherein the selected surface processor is exchangeable with the plurality of sorts of surface processors;

a memory section that stores an association between sorts of the surface processors and sorts of the recording mediums;

a decision section that obtains a sort of recording medium supplied from the medium supplying section and a sort of the surface processor involved in the secondary fixing section, and decides whether those sorts are associated with one another in the association stored in the memory section; and a guide section disposed between the primary fixing section and the secondary fixing section in the conveyance path, the guide section guiding the recording medium on which the toner image is fixed by the primary fixing section to a first conveyance path passing through the secondary fixing section, when the decision section decides that the sort of recording medium and the sort of the surface processor are associated with one another in the association stored in the memory section, and the guide section guiding the recording medium on which the toner image is fixed by the primary fixing section to a second conveyance path for making a detour to avoid the secondary fixing section, when the decision section decides that the sort of recording medium and the sort of the surface processor are not associated with one another in the association stored in the memory sections.

4. A printer according to claim 3, wherein the secondary fixing section has a plurality of sorts of surface processors;

the first conveyance path branches to a plurality of branch paths directed to the plurality of sorts of recording mediums;

the decision section decides the surface processor of the sort associated with the sort of the recording medium supplied from the medium supplying section in the association, of the plurality of surface processors involved in the secondary fixing section; and the guide section guides the recording medium to the branch path directed to the surface processor decided in the decision section.

5. A printer according to claim 3, wherein the printer further comprises an image display section that displays a surface condition of the toner image transferred by the image forming section and subjected to a surface processing by the surface processor before the medium supplying section supplies the recording medium.

6. A printer that forms a color image consisting of a fixed toner image on a conveyed recording sheet in such a manner that toner images by a plurality of colors of color toners are transferred and fixed on the recording sheet, the printer comprising:

an image forming section that forms toner images by a plurality of colors of color toners and transfers the same onto a recording sheet;

a primary fixing section that fixes a toner image transferred onto a recording sheet on the recording sheet;

a secondary fixing section that fuses at least a surface portion of the toner image fixed by the primary fixing section to regulate the surface of the toner image; and a distribution section that distributes recording sheets at an upper stream side with respect to a sheet conveyance direction of the secondary fixing section in a width direction intersecting the sheet conveyance direction.

7. A printer according to claim 6, wherein the distribution section is disposed between the first fixing section and the secondary fixing section, and distributes recording sheets carrying toner images after fixed in the first fixing section in the width direction.

8. A printer according to claim 6, wherein instead of an arrangement in which the distribution section is disposed separately from the primary fixing section, the primary fixing section distributes recording sheets in the width direction while fixing toner images transferred to recording sheets on the recording sheets.

9. A printer according to claim 6, wherein the printer further comprises a collecting section that collects the recording sheets distributed in the width direction and passing through the secondary fixing section, at a downstream side with respect to the sheet conveyance direction of the secondary fixing section.

10. An image forming method of forming a color image consisting of a fixed toner image on a conveyed recording sheet in such a manner that toner images by a plurality of colors of color toners are transferred and fixed on the recording sheet, the image forming method comprising:

an image forming step that forms toner images by a plurality of colors of color toners and transfers the same onto a recording sheet;

a primary fixing step that fixes a toner image transferred onto a recording sheet on the recording sheet;

a distribution step that distributes recording sheets on which toner images are fixed in the primary fixing step in a width direction intersecting the sheet conveyance direction;

a secondary fixing step that fuses at least a surface portion of the fixed toner image on the recording sheets distributed in the distribution step to regulate the surface of the toner image.

11. An image forming method according to claim 10, wherein the distribution step distributes recording sheets carrying toner images after fixed in the first fixing step in the width direction.

12. An image forming method according to claim 10, wherein instead of an implementation in which the distribution step is executed independently of the primary fixing step, the primary fixing step distributes recording sheets in the width direction while fixing toner images transferred to recording sheets on the recording sheets.

13. An image forming method according to claim 10, wherein the image forming method further comprises a collecting step that collects the recording sheets carrying the fixed toner image regulated in surface in the secondary fixing step.

* * * * *